US012460913B2

(12) United States Patent
Thomalla et al.

(10) Patent No.: US 12,460,913 B2
(45) Date of Patent: Nov. 4, 2025

(54) CUT-AND-CAPTURE SYSTEMS FOR DEMILITARIZATION OF UNDERWATER MUNITIONS

(71) Applicant: GRADIENT TECHNOLOGY, Elk River, MN (US)

(72) Inventors: John T. Thomalla, Elk River, MN (US); John E. Herbert, Virginia Beach, VA (US); Nathan F. Nodland, Maple Grove, MN (US); Drew A. Strombeck, Plymouth, MN (US); Ryan M. Smith, Minnetonka, MN (US); Steve J. Schmit, Orono, MN (US)

(73) Assignee: GRADIENT TECHNOLOGY, Elk River, MN (US)

( * ) Notice: Subject to any disclaimer, the term of this patent is extended or adjusted under 35 U.S.C. 154(b) by 0 days.

(21) Appl. No.: 18/949,191

(22) Filed: Nov. 15, 2024

(65) Prior Publication Data

US 2025/0164225 A1 May 22, 2025

Related U.S. Application Data

(60) Provisional application No. 63/600,079, filed on Nov. 17, 2023.

(51) Int. Cl.
*F42D 5/04* (2006.01)
*F42B 33/06* (2006.01)

(52) U.S. Cl.
CPC ..... *F42D 5/04* (2013.01); *F42B 33/062* (2013.01)

(58) Field of Classification Search
CPC ..... F42B 33/062; F42B 33/06; F42D 5/04; C06B 21/0091
See application file for complete search history.

(56) References Cited

U.S. PATENT DOCUMENTS 3,270,754 A * 9/1966 Moeller ..... F02K 9/24 134/152
6,080,907 A * 6/2000 Miller ..... C06B 21/0091 134/22.12
7,225,716 B1 * 6/2007 Miller ..... F42B 33/062 86/50

(Continued)

*Primary Examiner* — Joshua E Freeman
(74) *Attorney, Agent, or Firm* — O'Connor & Company; Ryan P. O'connor

(57) ABSTRACT

Some variations provide a cut-and-capture system configured for demilitarization of an underwater munition, comprising: a docking platform that is sealably positionable onto an underwater munition; a first manipulator arm to manipulate the docking platform onto the munition; a high-pressure waterjet cutting tool configured to be reversibly sealably placed into the docking platform; a washout tool configured to be reversibly sealably placed in the docking platform, wherein the washout tool generates waste from the munition; a bladder that stores munition waste; a second manipulator arm to manipulate the cutting tool and the washout tool into the docking platform; an abrasive feed subsystem that delivers an abrasive to the cutting tool; and a system control module with electrical and hydraulic control hardware, to control the docking platform, cutting tool, abrasive feed subsystem, the washout tool. Other variations utilize a multifunctional device that contains the cutting tool, the washout tool, and other tools.

49 Claims, 10 Drawing Sheets

(56) References Cited

U.S. PATENT DOCUMENTS

| | | | | |
|---|---|---|---|---|
| 2002/0112598 | A1* | 8/2002 | Miller | F42B 33/062 86/50 |
| 2003/0010183 | A1* | 1/2003 | Reid | B24C 3/04 86/50 |
| 2007/0297320 | A1* | 12/2007 | Brummette | F42D 5/04 370/208 |
| 2009/0223355 | A1* | 9/2009 | Manders | F42B 33/062 89/1.13 |
| 2012/0000495 | A1* | 1/2012 | Schmit | B08B 9/0936 134/167 R |
| 2018/0080734 | A1* | 3/2018 | Miller | B24C 7/0015 |
| 2020/0408497 | A1* | 12/2020 | Schmit | F41B 9/0087 |
| 2021/0310781 | A1* | 10/2021 | Dingman | F41B 9/0087 |

* cited by examiner

CUT-AND-CAPTURE SYSTEMS FOR DEMILITARIZATION OF UNDERWATER MUNITIONS

PRIORITY DATA

This patent application is a non-provisional application claiming priority to U.S. Provisional Patent App. No. 63/600,079, filed on Nov. 17, 2023, which is hereby incorporated by reference herein.

FIELD OF THE INVENTION

The present invention generally relates to the use of abrasive waterjet technology to cut objects located at the bottom of a body of water.

BACKGROUND OF THE INVENTION

Munitions are encountered in a variety of underwater environments as unexploded ordnance or discarded military munitions. These underwater objects can cause unacceptable explosive risk to critical infrastructure, endangered ecosystems, sensitive marine ecosystems, recreational divers, and fishermen. The objects can also wash up on-shore and place people at serious risk of death or injury from an explosion.

The problem is widespread. Discarded military munitions and unexploded ordnance are found in the waters surrounding nearly every active, or formerly active, coastal military target range or military ammunition port in the United States. The U.S. Department of Defense seeks to remove or deactivate these underwater objects in sensitive marine environments and those with significant public access, such as Culebra and Vieques, Puerto Rico, as well as Ordnance Reef in Hawaii.

The problem is certainly not limited to the United States. Internationally, in view of the increasing utilization of the seafloor for economic purposes (e.g. offshore wind farms, sea cables, and pipelines), the risk of encountering sea-dumped munitions is increasing. For example, many undersea munitions historically dumped in the Baltic Sea are now causing problems for developing wind farms on the sea. The European Parliament adopted a resolution in 2021 calling on European Union member states to jointly solve the problem of chemical weapons dumped in the framework of NATO-led operations (source: https://balticwind.eu, "Do WWII weapons dumped in the Baltic Sea pose a threat to wind energy?" retrieved Oct. 28, 2024).

Climate change may lead to changes in ocean current patterns, higher ocean temperatures, and a reduction in ocean pH (more acidic due to $CO_2$ conversion to carbonic acid). Such changes are already known to have major impacts on marine ecosystems and global climate patterns. Such ocean changes could potentially render underwater munitions more unstable. Also, a higher frequency of extreme weather events could accelerate the rate at which disposed ordnance corrodes or erodes, thereby accelerating the leakage rate of munition compounds. See Scharsack et al., "Effects of climate change on marine dumped munitions and possible consequence for inhabiting biota", *Environ Sci. Eur.* (2021) 33:102.

Remediation of discarded munitions located underwater has historically required placement of detonation charges by explosive ordnance disposal divers or recovery of the hazardous and potentially unstable ordnance for demilitarization of the munition on the surface (above water). In the case of explosive detonation, there is danger even to highly skilled divers when placing the explosive charges. Also, fish and marine mammals such as whales and dolphins can be killed or seriously injured up to several kilometers from an underwater detonation due to the explosive shock.

There is a desire to perform demilitarization of munitions underwater, by providing a tool package that can be deployed and operated from the surface. Such a system would avoid the need for divers to interact with underwater ordnance during remediation, avoiding potentially significant human impacts. There is also a desire for underwater demilitarization and ordnance remediation without detonation, providing a safer option for marine ecosystems and military defense.

SUMMARY OF THE INVENTION

Some variations of the invention provide a cut-and-capture system configured for demilitarization of an underwater munition, wherein the cut-and-capture system comprises:

(a) a docking platform that is sealably positionable onto an underwater munition;

(b) a first manipulator arm configured to manipulate the docking platform onto the underwater munition;

(c) a high-pressure entrainment-style waterjet cutting tool configured to be reversibly sealably placed into the docking platform when the docking platform is sealably positioned onto the underwater munition, wherein the high-pressure entrainment-style waterjet cutting tool is configured to apply high-pressure water and an abrasive to the underwater munition, to create a munition coupon and to provide a munition access hole;

(d) a second manipulator arm configured to manipulate the high-pressure entrainment-style waterjet cutting tool into the docking platform;

(e) an abrasive feed subsystem configured to controllably deliver the abrasive to the high-pressure entrainment-style waterjet cutting tool;

(f) a washout tool configured to be reversibly sealably placed in the docking platform when the docking platform is sealably positioned onto the underwater munition, wherein the second manipulator arm, or a third manipulator arm, is configured to manipulate the washout tool into the docking platform, and wherein the washout tool is configured to generate munition waste derived from the underwater munition;

(g) a munition-waste bladder configured to receive and store the munition waste when in flow connection, via a sealed bladder line, with the docking platform; and (h) at least a first system control module configured with electrical control hardware and optionally with hydraulic control hardware, wherein the system control module is configured to control the docking platform, the high-pressure entrainment-style waterjet cutting tool, the abrasive feed subsystem, and the washout tool.

In some embodiments, the docking platform is capable of being sealably positioned onto the underwater munition using munition clamps, magnets, electromagnets, suction, or a combination thereof.

In some embodiments, the high-pressure entrainment-style waterjet cutting tool is rotatable and/or translatable to create a circular or slotted form of the munition coupon from the underwater munition.

In some embodiments, the cut-and-capture system further comprises a coupon-removal tool configured to remove the munition coupon from the munition access hole.

In some embodiments, the cut-and-capture system contains a pump configured to convey surrounding water through the docking platform and into the munition-waste bladder during cutting, washout, inspection, plugging, or tool changes.

In some embodiments, the washout tool contains a washout nozzle. The washout nozzle may be configured to wash out the underwater munition via the munition access hole with the high-pressure water and/or with a liquid source different than the high-pressure water.

In some embodiments, the cut-and-capture system further comprises a cleaning tool configured to be mobilized by the second manipulator arm or a third manipulator arm, wherein the cleaning tool is configured with a cleaning nozzle to clean a surface of the underwater munition using the high-pressure water and/or a liquid source different than the high-pressure water.

In some embodiments, the cut-and-capture system further comprises a defusing tool configured to disarm a fuse within the underwater munition.

In some embodiments, the cut-and-capture system further comprises an inspection tool configured to be reversibly and sealably placed into the docking platform when the docking platform is sealably positioned onto the underwater munition. For example, a visible-light camera, an infrared camera, or a sonar detector may be installed within the inspection tool to view or analyze an inside region of the underwater munition.

In some embodiments, the cut-and-capture system further comprises a plugging tool configured to seal the munition access hole.

In some embodiments, the cut-and-capture system contains a tool rack configured to hold a plurality of tools, and wherein the tool rack is adapted with tool cable retractors to enable use of a selected tool.

In some embodiments, the cut-and-capture system further comprises one or more pressurized air tanks configured to supply air to the abrasive feed subsystem. The pressurized air tanks may be replaceable underwater via a hot-stab connection performed by the second manipulator arm or another manipulator arm.

In some embodiments, the first system control module is configured to also control the first manipulator arm and the second manipulator arm.

In some embodiments, the cut-and-capture system further comprises a second system control module, wherein the second system control module is configured to control the first manipulator arm and the second manipulator arm.

In some embodiments, the first system control module is powered and communicated via an umbilical that connects to power and communications equipment above water.

In other embodiments, the first system control module is powered via an underwater utility module.

In some embodiments, the cut-and-capture system further comprises a remotely operated vehicle. The remotely operated vehicle is preferably disposed in electrical communication with the first system control module and/or with a second system control module contained on the remotely operated vehicle.

In some embodiments, the remotely operated vehicle is configured to operate the first manipulator arm and the second manipulator arm.

In some embodiments, the first manipulator arm and the second manipulator arm are operated by a second system control module that is part of a remotely operated vehicle, while the docking platform, the high-pressure entrainment-style waterjet cutting tool, the abrasive feed subsystem, and the washout tool are operated by the first system control module.

The cut-and-capture system may be disposed on a skid. The cut-and-capture system may be configured with one or more buoyancy devices (e.g., buoyancy blocks or buoyancy bladders) attached to the skid.

When in use, the cut-and-capture system is submerged in a body of water.

Other variations of the invention provide a cut-and-capture system configured for demilitarization of an underwater munition, wherein the cut-and-capture system comprises:

(a) a multifunctional device that is positionable onto an underwater munition, wherein the multifunctional device is configured with (i) a high-pressure entrainment-style waterjet cutting tool, wherein the high-pressure entrainment-style waterjet cutting tool is configured to apply high-pressure water and an abrasive to the underwater munition, to create a munition coupon and to provide a munition access hole; (ii) a washout tool configured to generate munition waste derived from the underwater munition; and (iii) optionally, additional tools;

(b) a manipulator arm configured to manipulate the multifunctional device onto the underwater munition;

(c) an abrasive feed subsystem configured to controllably deliver the abrasive to the high-pressure entrainment-style waterjet cutting tool;

(d) a munition-waste bladder configured to receive and store the munition waste when in flow connection, via a sealed bladder line, with the multifunctional device; and (e) at least a first system control module configured with electrical control hardware and optionally with hydraulic control hardware, wherein the system control module is configured to control the multifunctional device and the abrasive feed subsystem.

In some embodiments, the multifunctional device is capable of being sealably positioned onto the underwater munition using munition clamps, magnets, electromagnets, suction, or a combination thereof.

In some embodiments, the high-pressure entrainment-style waterjet cutting tool is rotatable and/or translatable to create a circular or slotted form of the munition coupon from the underwater munition.

In some embodiments, the multifunctional device further comprises a coupon-removal tool configured to remove the munition coupon from the munition access hole.

In some embodiments, the cut-and-capture system contains a pump configured to convey surrounding water through the multifunctional device and into the munition-waste bladder during cutting, washout, inspection, plugging, or tool changes. The munition-waste bladder may be configured with a single hose enabling flow from surrounding water through the multifunctional device into the bladder, or with two hoses to enable flow of the surrounding water through the munition-waste bladder and back to the multifunctional device.

In some embodiments, the multifunctional device contains a washout tool which contains a washout nozzle configured to wash out the underwater munition via the munition access hole with the high-pressure water and/or with a liquid source different than the high-pressure water.

In some embodiments, the multifunctional device further comprises a defusing tool configured to disarm a fuse within the underwater munition.

In some embodiments, the multifunctional device further comprises an inspection tool. A visible-light camera, an infrared camera, or a sonar detector may be installed within the inspection tool to view or analyze an inside region of the underwater munition, for example.

In some embodiments, the multifunctional device further comprises a cleaning tool configured with a cleaning nozzle to clean a surface of the underwater munition using the high-pressure water and/or a liquid source different than the high-pressure water.

In some embodiments, the multifunctional device further comprises a plugging tool configured to seal the munition access hole.

In some embodiments, the cut-and-capture system further comprises one or more pressurized air tanks configured to supply air to the abrasive feed subsystem. The pressurized air tanks may be replaceable underwater via a hot-stab connection performed by the manipulator arm or another manipulator arm.

In some embodiments, the first system control module is configured to also control the manipulator arm.

In some embodiments, the cut-and-capture system further comprises a second system control module. The second system control module may be configured to control the manipulator arm.

In some embodiments, the first system control module is powered and communicated via an umbilical that connects to power and communications equipment above water.

In some embodiments, the first system control module is powered via an underwater utility module.

In some embodiments, the cut-and-capture system further comprises a remotely operated vehicle. The remotely operated vehicle may be configured to operate the first arm.

The remotely operated vehicle is preferably disposed in electrical communication with the first system control module and/or with a second system control module contained on the remotely operated vehicle. In certain embodiments, the manipulator arm is operated by the second system control module, and the multifunctional device is operated by the first system control module.

The cut-and-capture system may be disposed on a skid. The cut-and-capture system may be configured with one or more buoyancy devices attached to the skid.

The cut-and-capture system is submerged in a body of water, when the cut-and-capture system is being used.

DETAILED DESCRIPTION OF EMBODIMENTS OF THE INVENTION

Figure 1:
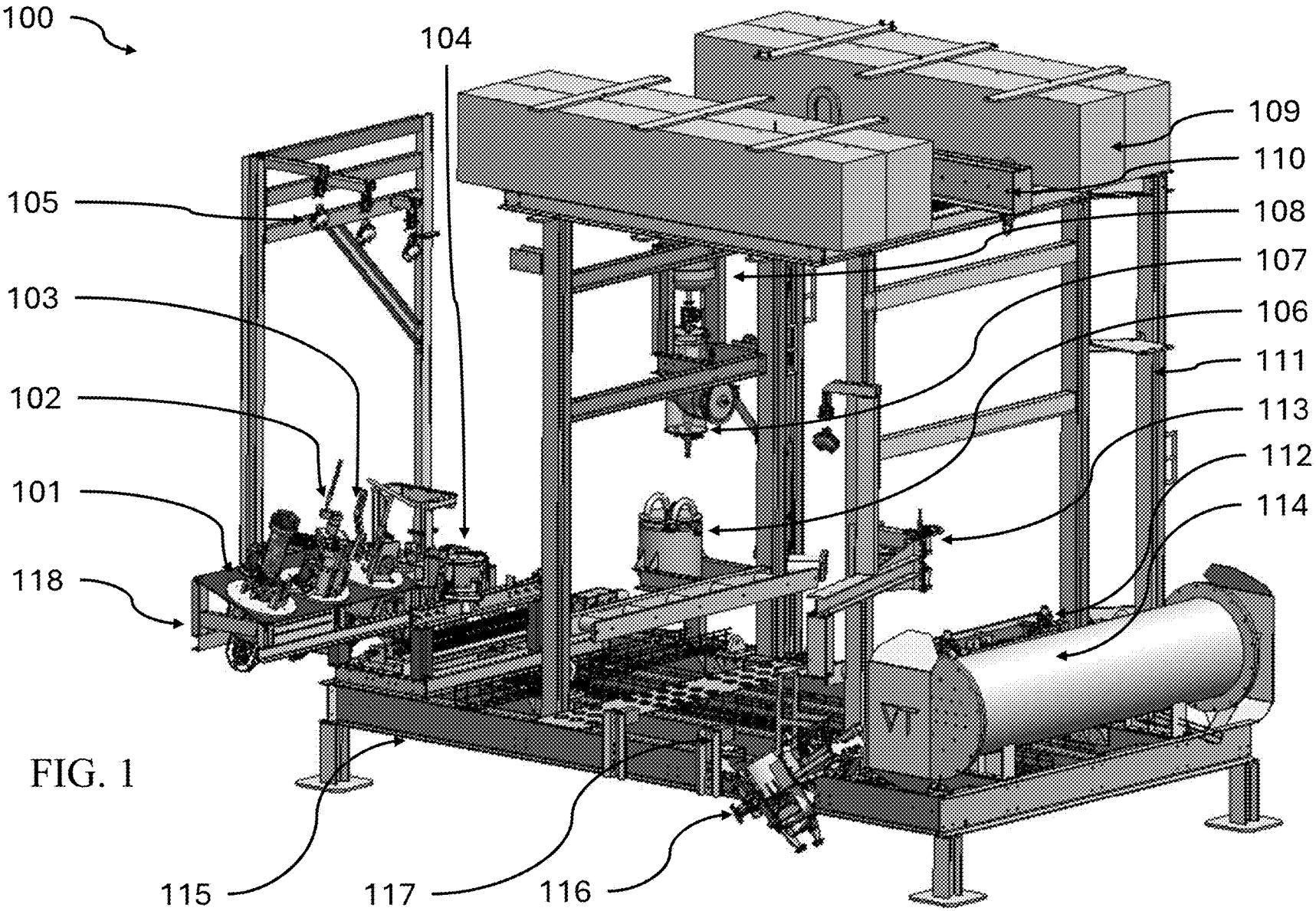
FIG. 1 is an illustration of an exemplary cut-and-capture system configured for demilitarization of an underwater munition, including a cutting tool, a washout tool, an inspection tool, a cleaning tool, a cable retractor, a blanketing valve chamber, an abrasive feeder, an abrasive hopper, buoyancy devices, a spreader bar, an auxiliary frame, a capture pump, a dock rack, a system control module, a main frame, a docking platform, docking pins, and a tool rack.

The systems (equivalently, apparatus) and methods of the present invention will be described in detail by reference to various non-limiting embodiments.

This description will enable one skilled in the art to make and use the invention, and it describes several embodiments, adaptations, variations, alternatives, and uses of the invention. These and other embodiments, features, and advantages of the present invention will become more apparent to those skilled in the art when taken with reference to the following detailed description of the invention in conjunction with the accompanying drawings.

As used in this specification and the appended claims, the singular forms "a," "an," and "the" include plural referents unless the context clearly indicates otherwise. Unless defined otherwise, all technical and scientific terms used herein have the same meaning as is commonly understood by one of ordinary skill in the art to which this invention belongs.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phrase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phrase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms, except when used in Markush groups. Thus in some embodiments not otherwise explicitly recited, any instance of "comprising" may be replaced by "consisting of" or, alternatively, by "consisting essentially of."

The present invention provides a demilitarization tool package that can be deployed underwater and operated from the surface (above water). Such a system avoids the need for divers to interact with underwater ordnance during remediation, avoiding potentially significant negative impacts to humans. The disclosed systems allow for ordnance remediation without detonation, providing a safer technology for demilitarization.

Reference will be made in this specification to an "underwater cut-and-capture system" which is synonymous with "cut-and-capture system", it being understood that the system is intended to be used underwater but that the system, or components thereof, are first fabricated above water.

In some embodiments, an underwater cut-and-capture system consists of an array of specialized equipment that is used to demilitarize underwater munitions. The system is transported to the munition of interest where—in a sealed environment—the cutting tool, using a high-pressure waterjet, cuts an access hole in the munition. The resulting cut-out coupon is removed from the munition and then a washout tool, using a high-pressure washout nozzle, is inserted to wash out the energetic fill. The entire operation is preferably conducted in a sealed environment, such as with the use of a specialized munition seal that seals the interface between the equipment and the munition. During the cutting and washout operations, surrounding seawater (or other surrounding water) is circulated through the equipment via a pump in which the discharge is connected to a subsea bladder, thus avoiding contamination of the subsea environment.

The underwater cut-and-capture system is preferably maintained in a sealed environment. This means that although the entire system at the point of use is submerged subsea, the components of the system are sealed to prevent infiltration of surrounding water into the processing equipment except where water intake is intended, such as into a pump to convey surrounding water through the docking platform and into the underwater bladder during cutting and/or washout.

The object to be cut is submerged within a body of water, which is typically a sea or ocean, but can also be a lake, a reservoir, a river, a pond, or a wetland, for example. In this specification, the term "subsea" may be used, with the understanding that the body of water is not necessarily a sea. By "underwater" it is meant that the object to be cut is resting at the bottom of a body of water, although in principle some movement of the object may take place naturally (e.g., due to pressure or thermal gradients) or may take place while the object is being cut.

In this specification, "demilitarization" includes, but is not limited to, neutralizing, stabilizing, deactivating, degrading, disarming, or defusing a munition of interest.

Some variations of the invention provide a cut-and-capture system configured for demilitarization of an underwater munition, wherein the cut-and-capture system comprises:

(a) a docking platform that is sealably positionable onto an underwater munition;

(b) a first manipulator arm configured to manipulate the docking platform onto the underwater munition;

(c) a high-pressure entrainment-style waterjet cutting tool configured to be reversibly sealably placed into the docking platform when the docking platform is sealably positioned onto the underwater munition, wherein the high-pressure entrainment-style waterjet cutting tool is configured to apply high-pressure water and an abrasive to the underwater munition, to create a munition coupon and to provide a munition access hole;

(d) a second manipulator arm configured to manipulate the high-pressure entrainment-style waterjet cutting tool into the docking platform;

(e) an abrasive feed subsystem configured to controllably deliver the abrasive to the high-pressure entrainment-style waterjet cutting tool;

(f) a washout tool configured to be reversibly sealably placed in the docking platform when the docking platform is sealably positioned onto the underwater munition, wherein the second manipulator arm, or a third manipulator arm, is configured to manipulate the washout tool into the docking platform, and wherein the washout tool is configured to generate munition waste derived from the underwater munition;

(g) a munition-waste bladder configured to receive and store the munition waste when in flow connection, via a sealed bladder line, with the docking platform; and (h) at least a first system control module configured with electrical control hardware and optionally with hydraulic control hardware, wherein the system control module is configured to control the docking platform, the high-pressure entrainment-style waterjet cutting tool, the abrasive feed subsystem, and the washout tool.

A "docking platform" or "dock" is a piece of equipment placed onto the munition by a manipulator arm. The docking platform is preferably capable of being sealably positioned onto the underwater munition using munition clamps, magnets, electromagnets, suction, or a combination thereof. Cameras may be included in the dock to give operators easy viewing access to internals of the docking platform.

For example, munition clamps pull the munition into the munition seal of the docking platform. The munition clamps may be hydraulically driven munition clamps. Tooling clamps lock tools onto the dock after the second manipulator arm places the tools onto the dock. One at a time, the cutting tool, the washout tool, and optionally the inspection tool are placed into the docking platform and sealed to it via the tooling clamps. In some embodiments, an isolation valve is utilized. When tools are removed, the isolation valve actuates, prohibiting bulk fluid transfer from the internal cavity of the munition through the dock, avoiding contamination of the environment, for example. In certain embodiments, a hydraulically driven isolation valve seals the underwater munition from the surrounding environment during tool changes by actuating a gate, or sliding plate, which closes the opening that is created in the docking platform upon tool retraction. When the munition and tools are clamped onto the dock, the munition/docking platform/tool assembly is a nearly rigid assembly, completely sealed from the environment.

In some embodiments, the docking platform is configured with a munition-sealing element that conforms to the imperfect cylindrical face of the munition being processed.

In some embodiments, docking-platform capture plumbing ports allow for continuous controlled flow of ambient seawater through the docking platform into a bladder (which may be the munition-waste bladder or another bladder). This configuration provides continuous cleaning of the internals of the dock and tools during operations, without leakage into the environment. A valve may be used to control the inlet flow conveyed into the dock.

Some embodiments utilize a docking-platform isolation valve, which may be a hydraulically actuated valve that effectively seals the munition from the environmental water. When the docking platform does not have a tool inserted, the accessed munition cavity has the potential to be open to the environment. In some embodiments, before tool insertion and after tool removal, the docking-platform isolation valve moves a plate over an O-ring within the dock, sealing the accessed munition from the environment.

In this specification, a "manipulator arm" should be construed to mean a controllable mechanical device that is able to move an end effector to a position where it can interact with an object and perform a task (e.g., manipulating the docking platform). A manipulator arm may be made from several jointed segments that form an arm-like device. A manipulator arm may be designed with various degrees of freedom which determine how the manipulator arm can be manipulated. A manipulator arm may vary in length, depending on the number and length of individual arm segments. In addition to being controllable, a manipulator arm can also be programmable via a computer sending executable code to the manipulator arm. A manipulator arm is controlled by a system control module (discussed later).

An exemplary first manipulator arm is a heavy-duty manipulator arm that manipulates the docking platform onto the munition. The first manipulator arm may be attached to the side of a ROV. Alternatively, the first manipulator arm may be attached directly to the cut-and-capture system, without the use of a ROV. An exemplary first manipulator arm is a Schilling Robotics Atlas Manipulator (TechnipFMC, Houston, Texas, USA).

An exemplary second manipulator arm is a fine-tuned manipulator arm, to manipulate various tools into the docking platform. The second manipulator arm may be attached to the side of the ROV. Alternatively, the second manipulator arm may be attached directly to the cut-and-capture system, without the use of a ROV. The second manipulator arm may also be used to exchange pressurized air tanks (e.g., scuba tanks) during operations to support the abrasive feed system, or for other purposes. An exemplary second manipulator arm is a Schilling Robotics Titan 4 (T4) Manipulator (TechnipFMC, Houston, Texas, USA).

When first and second manipulator arms are fixed to the cut-and-capture system, then depending on the arm lengths, there will be a working volume—the volume such that both the manipulator arms can reach. In these embodiments, a munition inside the working volume can be processed, while a munition outside the working volume cannot be processed unless the munition is moved to the system, or the cut-and-capture system is moved to better reach the munition.

A "munition" is the item being processed by the underwater cut-and-capture system. Munitions may include bombs, missiles, bullets, shells, grenades, projectiles, missiles, torpedoes, mines, and artillery guns, for example.

A "cutting tool" is a tool capable of cutting a surface of a munition. A preferred cutting tool is a high-pressure entrainment-style waterjet cutting tool. The cutting tool mates onto the docking platform after the docking platform clamps onto a munition. The cutting tool preferably uses a high-pressure waterjet abrasive cutting head. The cutting tool allows for the cut and freeing of the coupon, providing access to the munition for washout and inspection processes. The cutting tool may be configured with a coupon-removal device, such as an actuated permanent magnet.

The high-pressure entrainment-style waterjet cutting tool may be part of a sub-system for conveying an abrasive intended to cut an underwater object. In various embodiments, such a sub-system is described in U.S. patent application Ser. No. 18/380,639, filed on Oct. 16, 2023, which is hereby incorporated by reference and is commonly owned with the present patent application.

In some embodiments, the cut-and-capture system includes a two-station high-pressure $H_2O$ manifold that is a normally closed set of hydraulic valves that restrict or allow flow of high-pressure water to the cutting head and the washout tool. In certain embodiments employing the cleaning tool, the cut-and-capture system includes a three-station high-pressure $H_2O$ manifold that is a normally closed set of valves that restrict or allow flow of high-pressure water to the cleaning tool, the cutting head, and the washout tool. In certain embodiments employing a second washout tool, the cut-and-capture system includes a four-station high-pressure $H_2O$ manifold that is a normally closed set of valves that restrict or allow flow of high-pressure water to the cleaning tool, the cutting head, the washout tool, and the second washout tool.

A "munition coupon" is a physical cutout of a portion of a munition, generated during the cutting operation. In some embodiments, the high-pressure entrainment-style waterjet cutting tool is rotatable and/or translatable to create a circular or slotted form of the munition coupon from the underwater munition. In various embodiments, the munition coupon may be circular, square, rectangular, or slotted, or may have a random geometry, for example. The size of a coupon may vary, such as from about 1 inch to about 48 inches in diameter (when circular) or effective diameter (for other shapes).

In some embodiments, the cut-and-capture system further comprises a coupon-removal tool configured to remove the munition coupon from the munition access hole. For example, an actuated magnet may be embedded in the high-pressure entrainment-style waterjet cutting tool, to remove the munition coupon from the munition access hole. The coupon-removal tool may be mounted inside of the cutting tool to allow for a permanent magnet, driven linearly via a hydraulic cylinder, to attach itself to the coupon through a protective housing (e.g., made from stainless steel). The housing around the actuated magnet prohibits abrasive and other debris from building up over numerous operational cycles. The coupon can be pushed off the device by retracting a hydraulic cylinder, for example.

A "munition-waste bladder" is a container used to house waste from munition processing. A munition-waste bladder may be contained in a tote that is physically separated from a skid that contains the docking platform, manipulator arms, cutting tool, abrasive feed subsystem, washout tool, and system control module. An exemplary volume of the munition-waste bladder is 500 to 1000 gallons.

In some embodiments, two hoses are permanently connected to the munition-waste bladder. Once the munition-waste bladder is placed on the seafloor, the manipulator arms connect the two hoses to the demil skid via subsea hot stabs, which are field connections that are actuated via the manipulator arms. The two hoses enable flow of the surrounding water through the munition-waste bladder and back to the docking platform. Depending on the length of the hoses, the munition-waste bladder does not need to be physically adjacent to the demil skid, although the bladder and skid are preferably in close proximity to each other during demilitarization.

In some embodiments, the cut-and-capture system contains a capture pump configured to convey surrounding water through the docking platform and into the munition-waste bladder during cutting, washout, inspection, plugging, or tool changes. This capture pump may be a diaphragm pump, which may be a hydraulically driven dual diaphragm pump, for example. The capture pump is preferably able to handle a slurry of large solids, air, liquids, and abrasive.

A "washout tool" is a tool that, once placed in the dock, washed out munition waste from inside the munition. The washout tool may use high-pressure plumbing as a rotary and linear shaft, which terminates at a washout head. This allows for the washout head to penetrate the munition through the access hole where the coupon had been removed by the cutting tool. Once the washout head enters the opening of the munition, rotary and linear control of the washout head is available to move the focus of the orifices, which are threaded into the washout head, to the nose and tail of the munition. There may be 1 to 5 orifices, for example. While high-pressure water scrapes the inside of the munition, fluid is removed from the docking platform via the capture network, thus reducing and eventually eliminating the explosive contents of the munition.

In some embodiments, the washout tool contains a washout nozzle. The washout nozzle may be configured to wash out the underwater munition via the munition access hole with the high-pressure water and/or with a liquid source different than the high-pressure water.

In some embodiments, the cut-and-capture system further comprises a cleaning tool. The cleaning tool is used to clean off the surface of the munition as well as remove sand or other material in the munition's nearby environment. This provides adequate clearance around the munition and an optimal surface quality for sealing the munition against the docking platform's munition seal. The cleaning tool is typically used before placing the docking platform onto the munition. The cleaning tool may configured to be mobilized by the second manipulator arm or a third manipulator arm. The cleaning tool is preferably configured with a cleaning nozzle (e.g., a rotary-actuated nozzle) to clean a surface of the underwater munition using the high-pressure water and/or a liquid source different than the high-pressure water.

A liquid source other than water, for washout and/or cleaning, may be selected from hydrocarbons, alcohols, polyols, or compressed $CO_2$, for example. Preferably, the liquid is not toxic to the marine environment. Specific examples include, but are not limited to, ethanol, glycerol, and polyvinyl alcohol.

In some embodiments, the cut-and-capture system further comprises a defusing tool configured to disarm a fuse within the underwater munition. The defusing tool is typically used after (optional) cleaning and may be used before or after washout, as well as before or after inspection. In some cases, the washout tool is effective for defusing. In other embodiments, depending on the munition type and fuse assembly, a distinct defusing tool is desirable. The defusing tool may be similar to the cutting tool in that it also utilizes high-pressure entrainment-style waterjet cutting with abrasive. Alternatively, defusing tool may be configured to inject a chemical to decompose the fuse or solidify a material around the fuse, for example. The defusing tool may be used to defuse impact fuses, proximity fuses, time fuses, magnetic fuses, acoustic fuses, spring-loaded fuses, or pencil detonators, for example.

In some embodiments, the cut-and-capture system further comprises an inspection tool. An "inspection tool" allows for inspection of the munition after the washout operation, to validate the cleanliness of the munition's internal cavity. The inspection tool may be configured to be reversibly and sealably placed into the docking platform when the docking platform is sealably positioned onto the underwater munition. For example, a visible-light camera, an infrared camera, or a sonar detector may be installed within the inspection tool to view or analyze an inside region of the underwater munition. A camera allows viewing the inside of the munition in order to observe the post-washout cleanliness. An infrared camera may accomplish the same thing, without requiring visible light. Optionally, a light source (e.g., LED light) may be included in the inspection tool to provide light for the visible-light camera. Ultrasound may be used to evaluate the thickness of the munition, before or after washout. X-rays may be used to evaluate the munition walls, for example. An inspection tool may also be used to assist in navigation of other tools, such as the washout tool, within the munition.

In some embodiments, an inspection tool is mobilized via the second manipulator arm from the tool rack to the docking platform, where the inspection tool is clamped and sealed onto the docking platform. The second manipulator arm is then used to manually slide the inspection tool into the munition, where rotation and vertical movements of the camera are driven by the second manipulator arm. This allows an operator to view the nose, tail, and entire length of the internal cavity of the item. In some embodiments, the drivetrain of the inspection tool consists of linear, rotary, or endoscopic movements that are remotely actuated.

In some embodiments, the cut-and-capture system further comprises a plugging tool configured to seal the munition access hole. The plugging tool is used after the coupon is made from the cutting tool, and after the washout operation. The plugging tool may be configured to form a plug using a polymer composite, a ceramic composite, or a carbon composite, for example. The plug may use a material that expands to better seal within the hole, such as a hydrophilic, swelling polymer. Typically, the plug is pre-fabricated based on hole dimension and then installed into the munition access hole. Preferably, the plug is watertight to prevent leakage. When multiple coupons are cut from a munition (multiple access holes, in sequence or in parallel), multiple plugs may be used, one for each coupon. For some munitions such as a long missile, a large number of plugs may be necessary.

In some embodiments, the cut-and-capture system contains a tool rack configured to hold a plurality of tools. A "tool rack" should be construed as any framework suitable for reversibly holding plurality of tools. The tool rack is adapted with tool retractors to enable use of a selected tool. Tool retractors may be cables, or other means of retracting tools into and out of the tool rack. Tool retractors may also be mechanisms to adjust tension, slack, or positioning of the cables going to the tools, the integrated tooling system (ITS), or the docking platform. FIG. 1 shows one exemplary tool rack. There are not necessarily rails, bars, hooks, or wells in the tool rack. When tools are reversibly positionally sealed to the docking platform, the tool rack may be adapted with cable retractors to enable use of a selected tool without risk of damaging cable bundles during tool use.

The abrasive feed subsystem controllably delivers, on demand, an abrasive to the cutting tool or certain configurations of the washout tool. The purpose of the abrasive feed subsystem is to deliver a metered rate of abrasive to the cutting head to support removal of the coupon. Another purpose of the abrasive feed subsystem, in some embodiments, is to deliver a metered rate of abrasive in conjunction with high-pressure water in the washout tool to assist in removal efficiency of explosive content within the munition casing.

In some embodiments, the abrasive feed subsystem includes pressurized air tanks on a pressurized air tank rack, a blanketing valve chamber, an abrasive hopper, an abrasive feeder, and an abrasive valve. The blanketing valve chamber is the housing of the forward-pressure regulating valve, which is used to deliver 1 atm of absolute pressure from the pressurized air tank into the dry boxes housing the rest of the abrasive feed subsystem. In principle, the pressurized tanks may use a gas other than air (e.g., $O_2$, $N_2$, or $CO_2$).

An abrasive hopper is a structure for abrasive storage. An abrasive feeder regulates abrasive flow to the cutting head or specific configurations of the washout tool. An abrasive valve or multiple abrasive valves turns on/off the flow of abrasive to the cutting head or specific configurations of the washout tool.

In some embodiments, the cut-and-capture system further comprises one or more pressurized air tanks configured to supply air to the abrasive feed subsystem. The pressurized air tanks may be replaceable underwater via a hot-stab connection performed by the second manipulator arm or another manipulator arm. When a ROV is used, the manipulator arm that performs the pressurized air-tank hot stab can be performed by the ROV. A pressurized air tank rack may be a detachable rack that provides a means for the ROV to deliver additional pressurized air tanks containing large amounts of air to the demil skid as needed throughout operations. This may include a subsea air hot-stab connection, which is an ROV-actuated, subsea plumbing connection for pneumatics.

The abrasive may be a ceramic material. The abrasive may be selected from the group consisting of garnet, diamond, silicon carbide, silica, alumina, titanium dioxide, and combinations thereof. In preferred embodiments, the abrasive is a garnet. A garnet abrasive is an abrasive blasting material consisting of minerals from the garnet family, which includes almandite, andradite, grossularite, pyrope, and spessartite. Garnets have the general chemical formula $A_3B_2Si_3O_{12}$, where A is a divalent cation ($Fe^{2+}$, $Ca^{2+}$, $Mg^{2+}$, or $Mn^{2+}$) and B is a trivalent cation ($Fe^{3+}$, $Al^{3+}$, or $Cr^{3+}$).

This specification hereby incorporates by reference U.S. patent application Ser. No. 18/380,639, filed on Oct. 16, 2023, for various abrasive feed subsystems and methods of using them, which may be applied to the disclosed technology herein.

In some embodiments employing a remotely operated vehicle, the system further comprises one or more pressurized air tanks configured to supply air to the abrasive feed subsystem, and the pressurized air tanks are replaceable underwater via a hot-stab connection performed by the remotely operated vehicle.

A "system control module" is a module, typically a manifold, that contains electronic hardware, wired connections, hydraulic manifold/valving (when hydraulics are employed), and various sensors. The system control module is typically a 1 atm absolute pressure dry box or a hydraulically filled, pressure-compensated housing. A system control module may also be a individual subsea-rated component such as a subsea-rated servo valve that is itself a control module and is not housed with other components. The system control module is configured with cables and plumbing that connect to the system components, in a manner that does not allow water to infiltrate the system control module. The system control module is powered and communicated with via the umbilical. In certain embodiments, the system control module is a subsea electronic and hydraulic manifold ("SEHM"). Hydraulic control hardware includes hydraulic control valves and a hydraulic manifold, for utilizing hydraulic fluid to do useful work and move tools around. The first system control module is typically configured with both electrical control hardware and hydraulic control hardware. However, it is possible for the first system control module to be solely electrically controlled, without hydraulics.

In some embodiments, the first system control module is configured to also control the first manipulator arm and the second manipulator arm, in addition to the docking platform, cutting tool, abrasive feed subsystem, and washout tool.

In some embodiments, the cut-and-capture system further comprises a second system control module, wherein the second system control module is configured to control the first manipulator arm and the second manipulator arm. The second system control module is typically configured with both electrical control hardware and hydraulic control hardware, although may be just electrical control hardware.

In some embodiments, the first system control module is powered and communicated via an umbilical that connects to power and communications equipment above water. An "umbilical" is the main set of power, hydraulic, fiber, and high-pressure water cables and tubes that extend from the system's support equipment on the ship to the demil skid. The umbilical is not depicted in the drawings.

In other embodiments, the first system control module is powered via an underwater utility module, rather than power coming via the umbilical. In these embodiments, an underwater utility module is configured to provide power, such as via batteries (e.g., lithium-ion batteries), to the cut-and-capture system. The underwater utility module may also be configured with communications, such as for transmitting and receiving acoustic signals.

In some embodiments, the cut-and-capture system further comprises a remotely operated vehicle ("ROV"). ROVs are unoccupied, maneuverable underwater machines that are operated by someone above the water surface. An exemplary ROV is a Schilling Robotics HD 150 (TechnipFMC, Houston, Texas, USA).

When a ROV is utilized, typically the ROV is reversibly contained within the cut-and-capture system. For example, the cut-and-capture system is disposed on a skid (e.g., FIG. 1), and the ROV is integrated (non-permanently) with the skid (e.g., FIG. 2). When a ROV is integrated within a cut-and-capture system, typically the ROV is structurally smaller than the skid, such as in FIG. 2. It is also possible for the ROV to be the larger structure, with the skid contained within the ROV.

In certain embodiments, a ROV is integrated in a more permanent fashion, and the entire system is a remotely operated cut-and-capture vehicle. The remotely operated cut-and-capture vehicle may have wheels or caterpillar tracks, for example.

The remotely operated vehicle is preferably disposed in electrical communication with the first system control module. The remotely operated vehicle typically contains its own system control module which may be a second system control, or may be used as the first system control module.

In some embodiments, the remotely operated vehicle is configured to operate the first manipulator arm and the second manipulator arm.

In some embodiments, the first manipulator arm and the second manipulator arm are operated by the second system control module; while the docking platform, the high-pressure entrainment-style waterjet cutting tool, the abrasive feed subsystem, and the washout tool are operated by the first system control module. In other embodiments, the first manipulator arm and the second manipulator arm are operated by the first system control module; while the docking platform, the high-pressure entrainment-style waterjet cutting tool, the abrasive feed subsystem, and the washout tool are operated by the second system control module. Generally, each of the first manipulator arm, second manipulator arm, docking platform, waterjet cutting tool, abrasive feed subsystem, and washout tool may be operated by the first system control module or the second system control module.

The cut-and-capture system may be disposed on a skid, or on multiple skids. A "skid" (or "demilitarization skid" or "demil skid") is a pre-fabricated, self-contained modular and transportable unit that houses the components of the cut-and-capture system, mounted on a frame.

Some embodiments of the cut-and-capture system utilize a skid comprising a main frame and optionally an auxiliary frame. A "main frame" is the primary structure supporting the assembly and rigidity of the cut-and-capture system. The cut-and-capture system may be lifted (such as by a crane) via lifting pad-eyes mounted to the main frame. The main frame may be fabricated from a metal, such as aluminum, a metal alloy, a polymer, a ceramic, or a combination thereof. An "auxiliary frame" is a structure mounted to the main frame. Supporting equipment, such as the abrasive feed system, cameras, dock rack, and buoyancy blocks may be mounted to the auxiliary frame; see FIG. 1, described in detail below. The auxiliary frame may be fabricated from a metal, such as aluminum, a metal alloy, a polymer, a ceramic, or a combination thereof. In some embodiments, a skid comprises a single frame, combining the main frame and the auxiliary frame. One or more buoyancy devices (e.g., buoyancy blocks or buoyancy bladders) may be attached to the skid.

Figure 2:
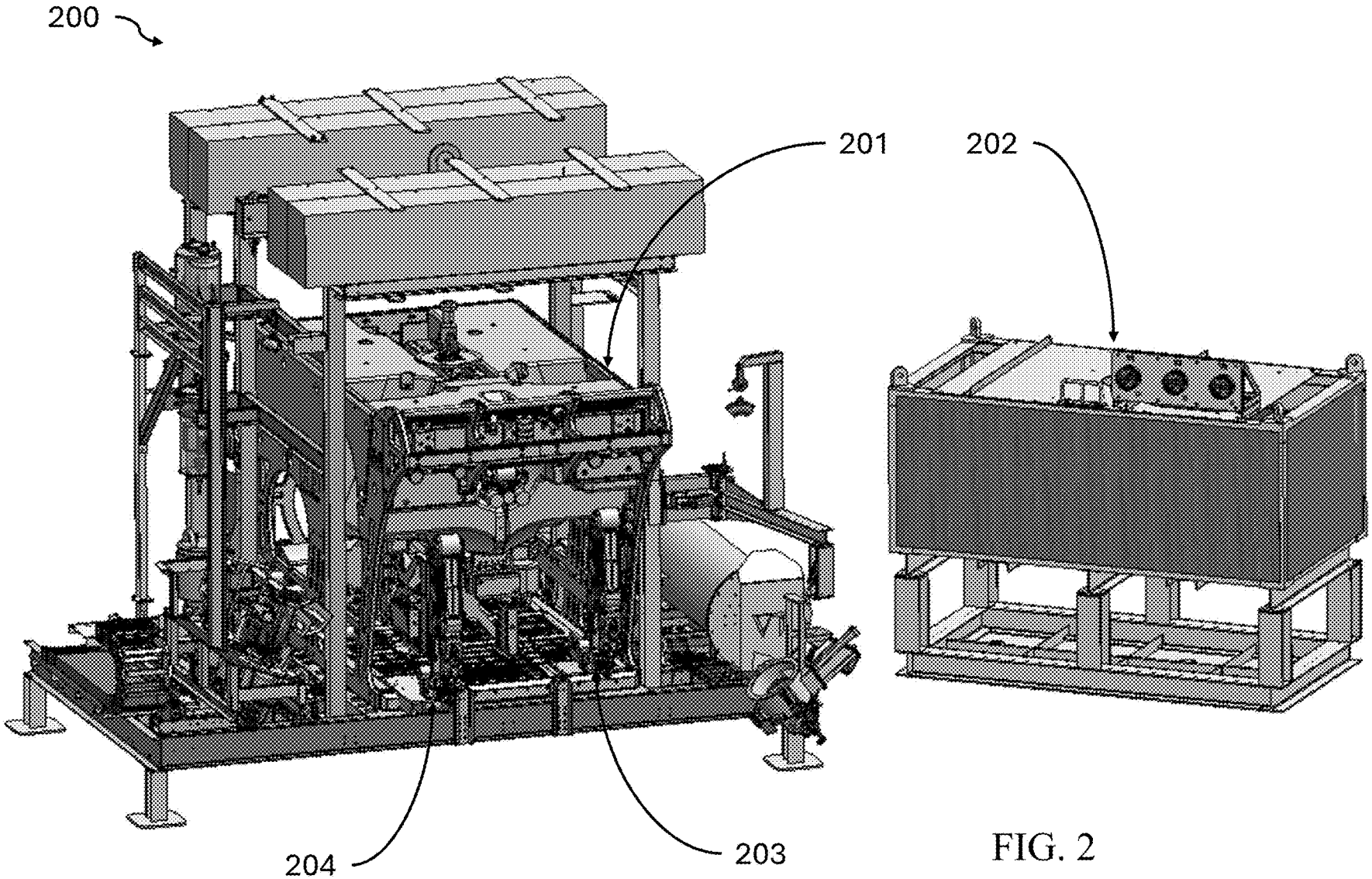
FIG. 2 is an illustration of an exemplary cut-and-capture system configured for demilitarization of an underwater munition, including a remotely operated vehicle (ROV), a munition-waste bladder that is underwater, a first manipulator arm, and a second manipulator arm, wherein the first and second manipulator arm are structurally part of the ROV.

In some embodiments, such as depicted in FIG. 2, the munition-waste bladder is contained on a separate skid or tote that is near a primary skid. In other embodiments, the munition-waste bladder is contained on the same skid as the other components. In certain embodiments, the munition-waste bladder is contained on a supporting secondary remotely operated vehicle that is different than the primary ROV. The secondary ROV may be a Schilling Robotics HD150 or a smaller inspection-class ROV, such as a Defender ROV (VideoRay LLC, Pottstown, Pennsylvania, USA).

A bladder collection rate may range from about 0.1 gal/min to about 100 gal/min, such as about 5 gal/min. A typical bladder collection efficiency is 100%, calculated as a percentage of all washed-out munition waste that is actually received into the bladder. A collection efficiency of 100% means that no loss of munition waste occurs subsea, which is environmentally preferable. In certain embodiments, a small loss occurs, and the collection efficiency is at least about 95%, for example.

A typical bladder collection yield is calculated as a percentage of all munition waste (present in the munition before any treatment) that is actually received into the bladder. In various embodiments, the collection yield is about, or at least about, 80%, 85%, 90%, 95%, 99%, or 100%, for example. A collection yield of 100% means that all recoverable munition waste is actually recovered, which also is environmentally preferable. In less-preferred embodiments, the collection yield is less than 80%.

When in use, the cut-and-capture system is submerged in a body of water. The cut-and-capture system is typically placed on a ship before being lowered into the water. The cut-and-capture system may be attached to a crane while being lowered. The cut-and-capture system may be sitting at a port about to be loaded on a ship. The cut-and-capture system may be located at a shop or manufacturing facility following fabrication. While the cut-and-capture system is intended to be used underwater, note that the system is functional after fabrication, and could be used to cut a munition on dry land.

Other variations of the invention are premised on the utilization of a multifunctional device that incorporates the dock and multiple tools within the device. In other words, a single, multifunctional tool is used with the cutting tool, the washout tool, and potentially other tools (e.g., a cleaning tool) built into the dock itself. The multifunctional device is also referred to herein as an "integrated tool system" (ITS). In some of these variations, a cut-and-capture system is configured for demilitarization of an underwater munition, the system comprising:

(a) a multifunctional device that is positionable (preferably sealably positionable) onto an underwater munition, wherein the multifunctional device is configured with (i) a high-pressure entrainment-style waterjet cutting tool, wherein the high-pressure entrainment-style waterjet cutting tool is configured to apply high-pressure water and an abrasive to the underwater munition, to create a munition coupon and to provide a munition access hole; (ii) a washout tool configured to generate munition waste derived from the underwater munition; and (iii) optionally, additional tools;

(b) a manipulator arm configured to manipulate the multifunctional device onto the underwater munition;

(c) an abrasive feed subsystem configured to controllably deliver the abrasive to the high-pressure entrainment-style waterjet cutting tool;

(d) a munition-waste bladder configured to receive and store the munition waste when in flow connection, via a sealed bladder line, with the multifunctional device; and (e) at least a first system control module configured with electrical control hardware and optionally with hydraulic control hardware, wherein the system control module is configured to control the multifunctional device and the abrasive feed subsystem.

Unless otherwise stated, all embodiments and options described above for the cut-and-capture system with docking platform also apply to the cut-and-capture system with multifunctional device. The concepts may be combined, providing a cut-and-capture system that is configured with both a docking platform and a multifunctional device, in which case the multifunctional device has multiple integrated tools but not all system tools. For example, a cleaning tool may be used separately (as a standalone tool) from the multifunctional device, to clean the outside of the munition casing instead of the internal cavity of the munition. When is at least one standalone tool in addition to the multifunctional device, the multifunctional device may be referred to as a multifunctional tool which then becomes one of the tools that may be reversibly placed in the docking platform.

In some embodiments, the multifunctional device is capable of being sealably positioned onto the underwater munition using munition clamps, magnets, electromagnets, suction, or a combination thereof.

When a multifunctional device is used, there does not need to be two manipulator arms, although there could be. The manipulator arm is preferably a heavy-duty manipulator, such as a Schilling Robotics Atlas Manipulator, that manipulates the multifunctional device onto the munition.

In some embodiments, the high-pressure entrainment-style waterjet cutting tool is rotatable and/or translatable to create a circular or slotted form of the munition coupon from the underwater munition.

In some embodiments, the multifunctional device further comprises a coupon-removal tool configured to remove the munition coupon from the munition access hole.

In some embodiments, the cut-and-capture system contains a pump configured to convey surrounding water through the multifunctional device and into the munition-waste bladder during cutting, washout, inspection, plugging, or tool changes. The munition-waste bladder may be configured with two hoses to enable flow of the surrounding water through the munition-waste bladder and back to the docking platform.

In some embodiments, the washout tool contains a washout nozzle configured to wash out the underwater munition via the munition access hole with the high-pressure water and/or with a liquid source different than the high-pressure water.

In certain embodiments employing a multifunctional device, the washout tool is not contained in the multifunctional device but rather is a separate tool that is positionable onto the underwater munition. Thus a cut-and-capture system configured for demilitarization of an underwater munition may comprise:

(a) a multifunctional device that is positionable (preferably sealably positionable) onto an underwater munition, wherein the multifunctional device is configured with (i) a high-pressure entrainment-style waterjet cutting tool, wherein the high-pressure entrainment-style waterjet cutting tool is configured to apply high-pressure water and an abrasive to the underwater munition, to create a munition coupon and to provide a munition access hole; and (ii) optionally, additional tools;

(b) a manipulator arm configured to manipulate the multifunctional device onto the underwater munition;

(c) an abrasive feed subsystem configured to controllably deliver the abrasive to the high-pressure entrainment-style waterjet cutting tool;

(d) a washout tool that is positionable (preferably sealably positionable) onto the underwater munition, wherein the manipulator arm, or another manipulator arm, is configured to manipulate the washout tool onto the underwater munition, and wherein the washout tool is configured to generate munition waste derived from the underwater munition;

(e) a munition-waste bladder configured to receive and store the munition waste when in flow connection, via a sealed bladder line, with the multifunctional device; and (f) at least a first system control module configured with electrical control hardware and optionally with hydraulic control hardware, wherein the system control module is configured to control the multifunctional device and the abrasive feed subsystem.

In certain embodiments employing a multifunctional device, a first washout tool is contained in the multifunctional device and a second washout tool is a separate tool that is positionable onto the underwater munition. Thus a cut-and-capture system configured for demilitarization of an underwater munition may comprise:

(a) a multifunctional device that is positionable (preferably sealably positionable) onto an underwater munition, wherein the multifunctional device is configured with (i) a high-pressure entrainment-style waterjet cutting tool, wherein the high-pressure entrainment-style waterjet cutting tool is configured to apply high-pressure water and an abrasive to the underwater munition, to create a munition coupon and to provide a munition access hole; (ii) a first washout tool configured to generate munition waste derived from the underwater munition; and (iii) optionally, additional tools;

(b) a manipulator arm configured to manipulate the multifunctional device onto the underwater munition;

(c) an abrasive feed subsystem configured to controllably deliver the abrasive to the high-pressure entrainment-style waterjet cutting tool;

(d) a second washout tool that is positionable (preferably sealably positionable) onto the underwater munition, wherein the second washout tool is not part of the multifunctional device, wherein the manipulator arm, or another manipulator arm, is configured to manipulate the second washout tool onto the underwater munition, and wherein the second washout tool is configured to generate munition waste derived from the underwater munition;

(e) a munition-waste bladder configured to receive and store the munition waste when in flow connection, via a sealed bladder line, with the multifunctional device; and (f) at least a first system control module configured with electrical control hardware and optionally with hydraulic control hardware, wherein the system control module is configured to control the multifunctional device and the abrasive feed subsystem.

In some embodiments, the multifunctional device further comprises a defusing tool configured to disarm a fuse within the underwater munition.

In some embodiments, the multifunctional device further comprises an inspection tool. A visible-light camera, an infrared camera, or a sonar detector may be installed within the inspection tool to view or analyze an inside region of the underwater munition, for example.

In some embodiments, the multifunctional device further comprises a cleaning tool configured with a cleaning nozzle to clean a surface of the underwater munition using the high-pressure water and/or a liquid source different than the high-pressure water. In other embodiments, the cleaning tool remains separate and is not part of the multifunctional device.

In some embodiments, the multifunctional device further comprises a plugging tool configured to seal the munition access hole.

In some embodiments, the cut-and-capture system further comprises one or more pressurized air tanks configured to supply air to the abrasive feed subsystem. The pressurized air tanks may be replaceable underwater via a hot-stab connection performed by the manipulator arm or another manipulator arm.

In some embodiments, the multifunctional device may house high-pressure valves to go to the cutting head, cleaning head, washout tool, or a secondary washout tool.

In some embodiments, the multifunctional device comprises its own control module.

In some embodiments, the first system control module is configured to also control the manipulator arm.

In some embodiments, the cut-and-capture system further comprises a second, third, or fourth system control module. For example, a second system control module may be configured to control the manipulator arm.

In some embodiments, the first system control module is powered and communicated via an umbilical that connects to power and communications equipment above water.

In some embodiments, the first system control module is powered via an underwater utility module.

In some embodiments, the cut-and-capture system further comprises a remotely operated vehicle. The remotely operated vehicle may be configured to operate the first arm.

The remotely operated vehicle is preferably disposed in electrical communication with the first system control module and/or with a second system control module contained on the remotely operated vehicle. In certain embodiments, the manipulator arm is operated by the second system control module, and the multifunctional device is operated by the first system control module.

The cut-and-capture system may be disposed on a skid. The cut-and-capture system may be configured with one or more buoyancy devices attached to the skid.

The cut-and-capture system is submerged in a body of water, when the cut-and-capture system is being used. As noted previously, the system is not always underwater and may even be used above water if desired.

Variations of the present invention will now be further described in reference to the accompanying drawings, which are not intended to limit the scope of the invention as defined by the claims. The drawings (FIGS. 1 to 10) are all isometric views of three-dimensional systems.

FIG. 1 is an illustration of an exemplary cut-and-capture system 100 configured for demilitarization of an underwater munition. The cut-and-capture system 100 includes a cutting tool 101, a washout tool 102, an inspection tool 103, a cleaning tool 104, a cable retractor 105, a blanketing valve chamber 106, an abrasive feeder 107, an abrasive hopper 108, buoyancy devices 109, a spreader bar 110, an auxiliary frame 111, a capture pump 112, a dock rack 113, a system control module 114, a main frame 115, a docking platform 116, docking pins 117, and a tool rack 118. The cutting tool 101 is preferably a high-pressure entrainment-style waterjet cutting tool configured to be reversibly sealably placed into the docking platform 116 when that platform is sealably positioned onto the underwater munition. The cutting tool 101 applies high-pressure water and an abrasive to the underwater munition, to create a munition coupon and to provide a munition access hole. The washout tool 102 is configured to be reversibly sealably placed in the docking platform 116 when that platform is sealably positioned onto the underwater munition.

In FIG. 1, the dock rack 113 may be a hydraulically actuated cantilevered arm, which is mounted to the auxiliary frame and has a rotation range of roughly 0-100 degrees. The dock rack 113 can hold a high load, such as about 1000 lbf. The docking platform 116 may be placed onto the end of the dock rack 113 before and after use. The rack rotation may be actuated via a hydraulic cylinder. The docking platform 116 may be retained in position on the dock rack 113 via an ROV-actuated locking device or hydraulic cylinder that serves as a locking device, for example.

In FIG. 1, the tool rack 118 may be a dynamic rack that allows placement of several tools, such as 2, 3, 4, 5, 6, 7, 8, 9, 10, or more tools. The tool rack 118 may use a hydraulic drivetrain and rollers for two feet (or more) of linear motion. A cable track may be used to carry electronic, hydraulic, and pneumatic lines coming from the system control module(s) to miscellaneous components attached to the tools and other moving components attached to the tool rack 118.

In FIG. 1, the cable retractor 105 may be attached to a hose carrier, which allows for a controlled minimum bend radius of the hoses traveling from the tool rack 118 to the tools. A similar concept may be used to deliver cables from the dock rack 113 to the dock. The objective of the cable retractors is to keep cables out of the way of the manipulator arms as tools and the dock are moved around the working envelope.

In FIG. 1, the system control module 114 may be a subsea electronic and hydraulic manifold ("SEHM"). A SEHM is configured with electrical control hardware and with hydraulic control hardware. The SEHM controls at least the docking platform, the high-pressure entrainment-style waterjet cutting tool, the abrasive feed subsystem, and the washout tool.

An underwater munition is not shown in FIG. 1, since the underwater munition is not necessarily present. The cut-and-capture system 100 is fabricated on dry land, such as in a factory, a shop, or possibly on board a ship.

In some embodiments, the cut-and-capture system 100 is submerged into a body of water for a remotely operated vehicle ("ROV") to later provide one or more manipulator arms and/or other features. In these embodiments, FIG. 1 represents a snapshot in time prior to the ROV being connected to the cut-and-capture system 100.

FIG. 2 is an illustration of an exemplary cut-and-capture system 200 configured for demilitarization of an underwater munition. The cut-and-capture system 200 includes a remotely operated vehicle 201, a munition-waste bladder 202 that is underwater, a first manipulator arm 203, and a second manipulator arm 204. The first manipulator arm 203 and the second manipulator arm 204 are provided by, and structurally part of, the remotely operated vehicle 201. The cut-and-capture system 200 is essentially the cut-and-capture system 100 (FIG. 1) along with a remotely operated vehicle 201 and a munition-waste bladder 202.

Figure 3:
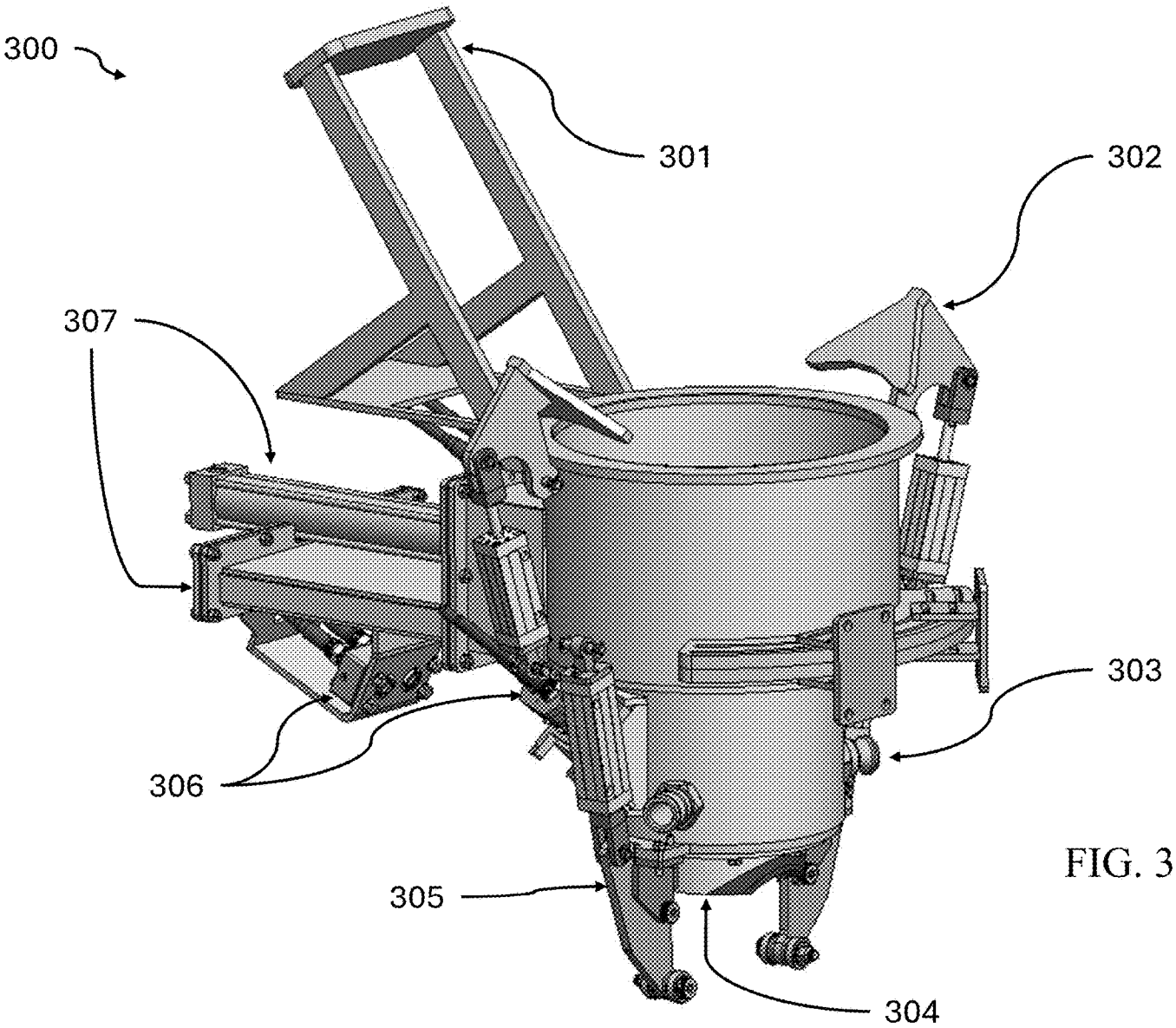
FIG. 3 is an illustration of an exemplary docking platform that is sealably positionable with an underwater munition, wherein the docking platform includes a hanger plate, tooling clamps, a waste capture port, a munition seal, munition clamps, a lighting/camera sub-system, and an isolation valve.

FIG. 3 is an illustration of an exemplary docking platform 300 that is sealably positionable with an underwater munition (not shown). The docking platform 300 may be used as the docking platform 116 in FIG. 1. The docking platform 300 includes a hanger plate 301, tooling clamps 302, a waste capture port 303, a munition seal 304, munition clamps 305, a lighting/camera sub-system 306, and an isolation valve 307. The isolation valve 307 (e.g., a gate valve) allows for a seal of the docking platform 300 during tool changes.

Figure 4:
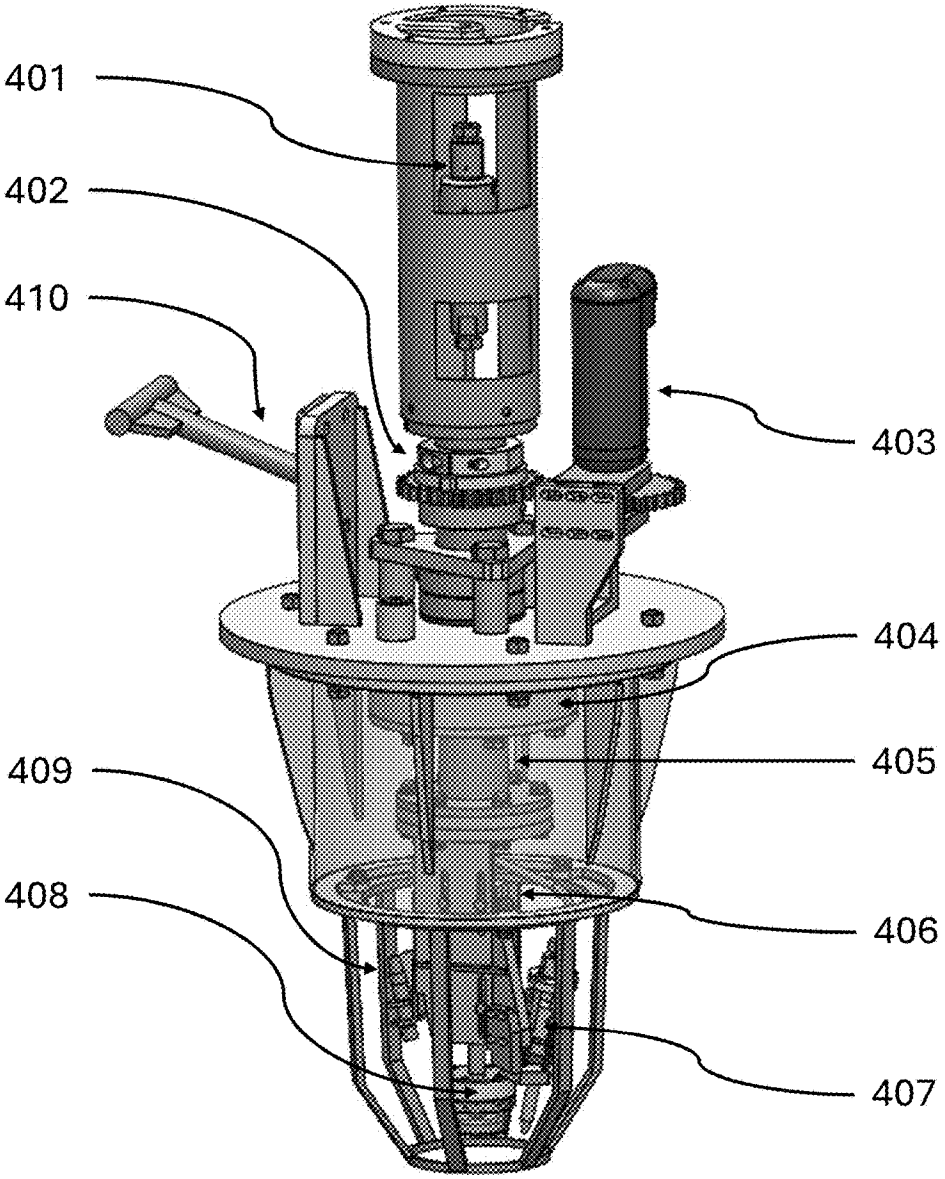
FIG. 4 is an illustration of an exemplary high-pressure entrainment-style waterjet cutting tool configured to be reversibly sealably placed into the docking platform when the platform is sealably positioned onto the underwater munition, and to apply high-pressure water and an abrasive to the underwater munition, wherein the cutting tool includes a high-pressure swivel, a rotary drive train, a rotary drive element, a rotary bearing and seal housing, a hollow drive shaft, a linear magnet drive element, an abrasive entrainment-style cutting head, a coupon removal device, an optional camera, and a handle.

FIG. 4 is an illustration of an exemplary high-pressure entrainment-style waterjet cutting tool 400 configured to be reversibly sealably placed into the docking platform 300 (FIG. 3) when that platform is sealably positioned onto the underwater munition. The cutting tool 400 includes a high-pressure swivel 401, a rotary drive train 402 (e.g., using spur gears), a rotary drive element 403, a rotary bearing and seal housing 404, a hollow drive shaft 405, a linear magnet drive element 406, an abrasive entrainment-style cutting head 407, a coupon removal device 408 (e.g., a shielded ferrous magnet), an optional camera 409, and a handle 410 (e.g., a T-handle or a fishtail handle). The cutting tool 400 applies high-pressure water and an abrasive to the underwater munition, to create a munition coupon and to provide a munition access hole. The cutting tool 400 may be used as the cutting tool 101 in FIG. 1.

Figure 5:
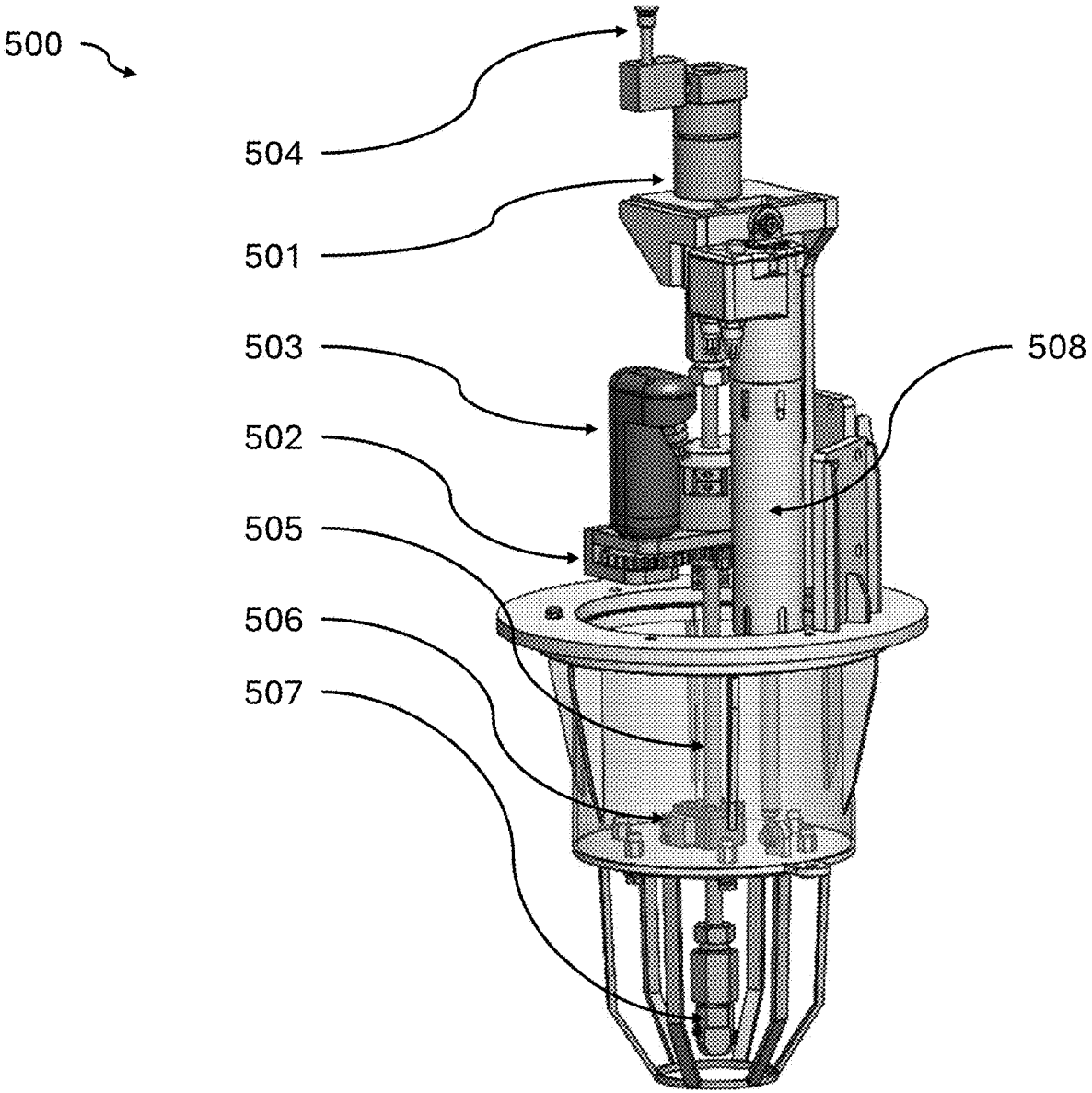
FIG. 5 is an illustration of an exemplary washout tool configured to be reversibly sealably placed in the docking platform when the platform is sealably positioned onto the underwater munition, wherein the washout tool includes a high-pressure swivel, a rotary drive train, a rotary drive element, high-pressure plumbing, a high-pressure rotary drive shaft, a rotary bearing and seal housing, a high-pressure single-orifice or multi-orifice washout head, and a linear drive element.

FIG. 5 is an illustration of an exemplary washout tool 500 configured to be reversibly sealably placed in the docking platform 300 (FIG. 3) when that platform is sealably positioned onto the underwater munition. The washout tool 500 includes a high-pressure swivel 501, a rotary drive train 502 (e.g., using spur gears), a rotary drive element 503, high-pressure plumbing 504, a high-pressure rotary drive shaft 505, a rotary bearing and seal housing 506, a high-pressure single-orifice or multi-orifice washout head 507, and a linear drive element 508. The washout tool 500 may be used as the washout tool 102 in FIG. 1.

Figure 6:
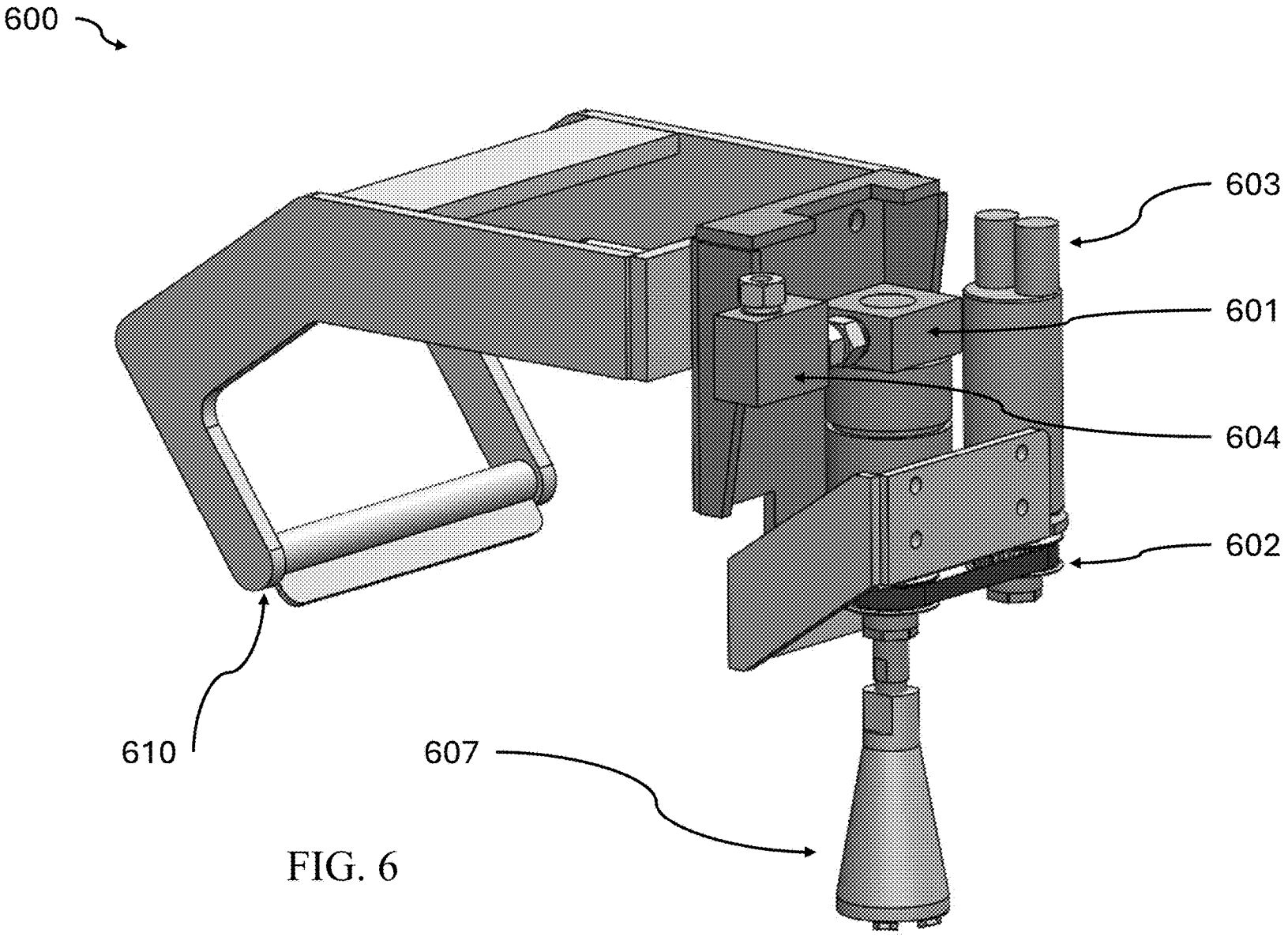
FIG. 6 is an illustration of an exemplary cleaning tool configured to clean a surface of the underwater munition, wherein the cleaning tool includes a high-pressure swivel, a rotary drive train, a rotary drive element, high-pressure plumbing, a high-pressure single-orifice or multi-orifice washout head, and a handle.

FIG. 6 is an illustration of an exemplary cleaning tool 600 configured to clean a surface of the underwater munition. The cleaning tool 600 includes a high-pressure swivel 601, a rotary drive train 602 (e.g., using a belt drive), a rotary drive element 603, high-pressure plumbing 604, a high-pressure single-orifice or multi-orifice washout head 608, and a handle 610 (e.g., a T-handle or a fishtail handle). The cleaning tool 600 may be used as the cleaning tool 104 in FIG. 1.

Figure 7:
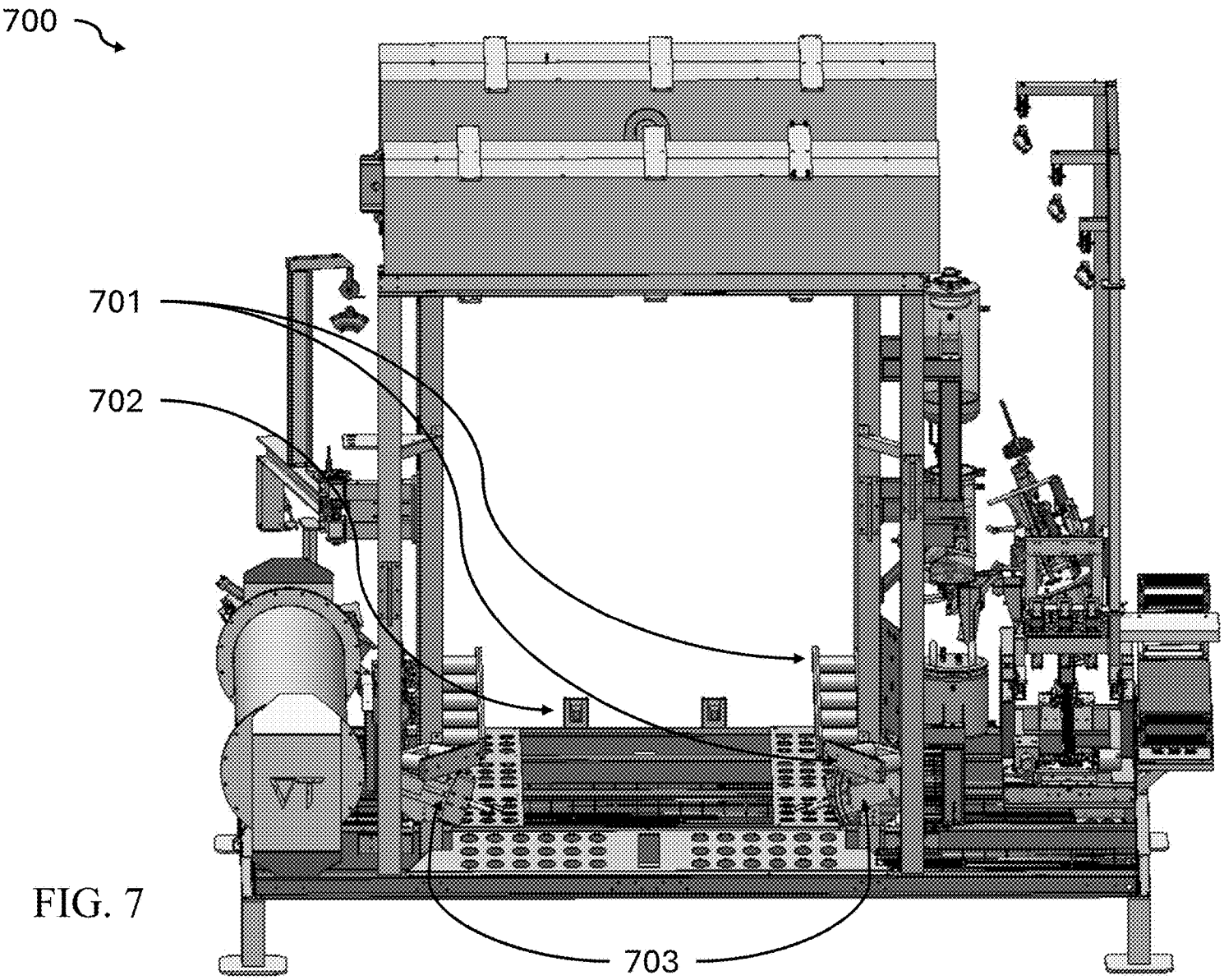
FIG. 7 is an illustration of an exemplary cut-and-capture system configured for demilitarization of an underwater munition, and also configured for docking a remotely operated vehicle (ROV; not shown), wherein the cut-and-capture system includes guide rails, ROV docking pins, and ROV tail latches.

FIG. 7 is an illustration of an exemplary cut-and-capture system 700 configured for demilitarization of an underwater munition, and also configured for docking a remotely operated vehicle (ROV). The cut-and-capture system 700 includes guide rails 701, ROV docking pins 702, ROV tail latches 703. The ROV itself is not depicted in FIG. 7, i.e., this drawing shows the system prior to the ROV docking therewithin. The cut-and-capture system 700 may receive a remotely operated vehicle 201 as shown in FIG. 2, for example, and may utilize a three-point docking of the ROV to the demil skid's main frame. The purpose of the ROV docking is to minimize movement of the ROV relative to the dock and tools during operations, as well as provide a platform for the ROV to pick up and relocate the demil skid by actuating its thrusters in an upwards and/or lateral direction. The three-point docking may use two male docking pins on the demil skid's main frame that are inserted into female slots on the ROV frame. A hydraulic tail latch then mates the back side of the ROV to the demil skid's mainframe. The ROV docking pins 702 align with the front end of the ROV during docking. The ROV tail latches 703 are the only actuated portion of the ROV docking. The ROV tail latches 703 clamp the rear end of the ROV to the main frame of the demil skid. ROV guide rails 701 provide a lateral taper for the ROV's entrance into the ROV docking system.

Figure 8:
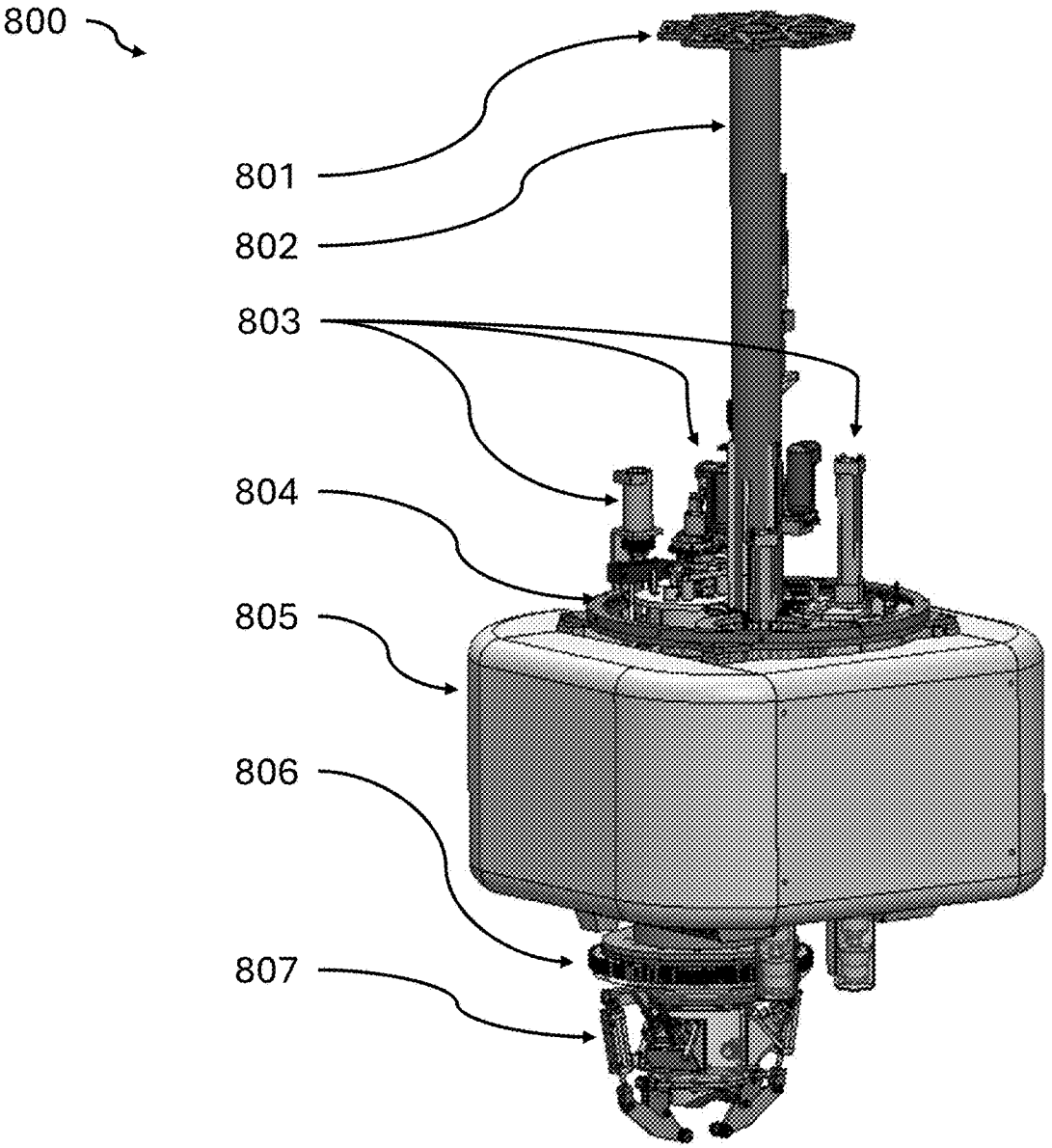
FIG. 8 is an illustration of an exemplary multifunctional device that may be used within a cut-and-capture system, wherein the multifunctional device includes a cable management apparatus, a hollow drive shaft that is connected to the cable management apparatus, a plurality of tools located on a rotary tool carousel that situates a desired tool over the integrated docking platform, a buoyancy device, and a rotating element configured to situate the clock position of the integrated docking platform relative to the rest of the multifunctional device.

FIG. 8 is an illustration of an exemplary multifunctional device 800 that may be used within a cut-and-capture system, instead of individual tools and a docking platform. The multifunctional device 800 includes a cable management apparatus 801, a hollow drive shaft 802 that is connected to the cable management apparatus 801, a plurality of tools 803 located on a rotary tool carousel 804 that situates a desired tool over the integrated docking platform 807, a buoyancy device 805 (e.g., one or more buoyancy blocks), and a rotating element 806 configured to situate the clock position of the integrated docking platform 807 relative to the rest of the multifunctional device 800. The integrated docking platform 807 may be a miniaturized version of the docking platform 300 (FIG. 3). The integrated docking platform 807 is preferably built into the rotary tool carousel 804. While FIG. 8 depicts 5 tools being present, the number of tools may vary, such as from 2 to 12. The multifunctional device 800 of FIG. 8 may also be referred to as an integrated tooling system ("ITS"). When the multifunctional device 800 is utilized in a cut-and-capture system, only one manipulator arm is necessary, to control the multifunctional device 800; a second manipulator arm is not needed to move around individual tools, since that function is performed by the integrated tooling system.

Figure 9:
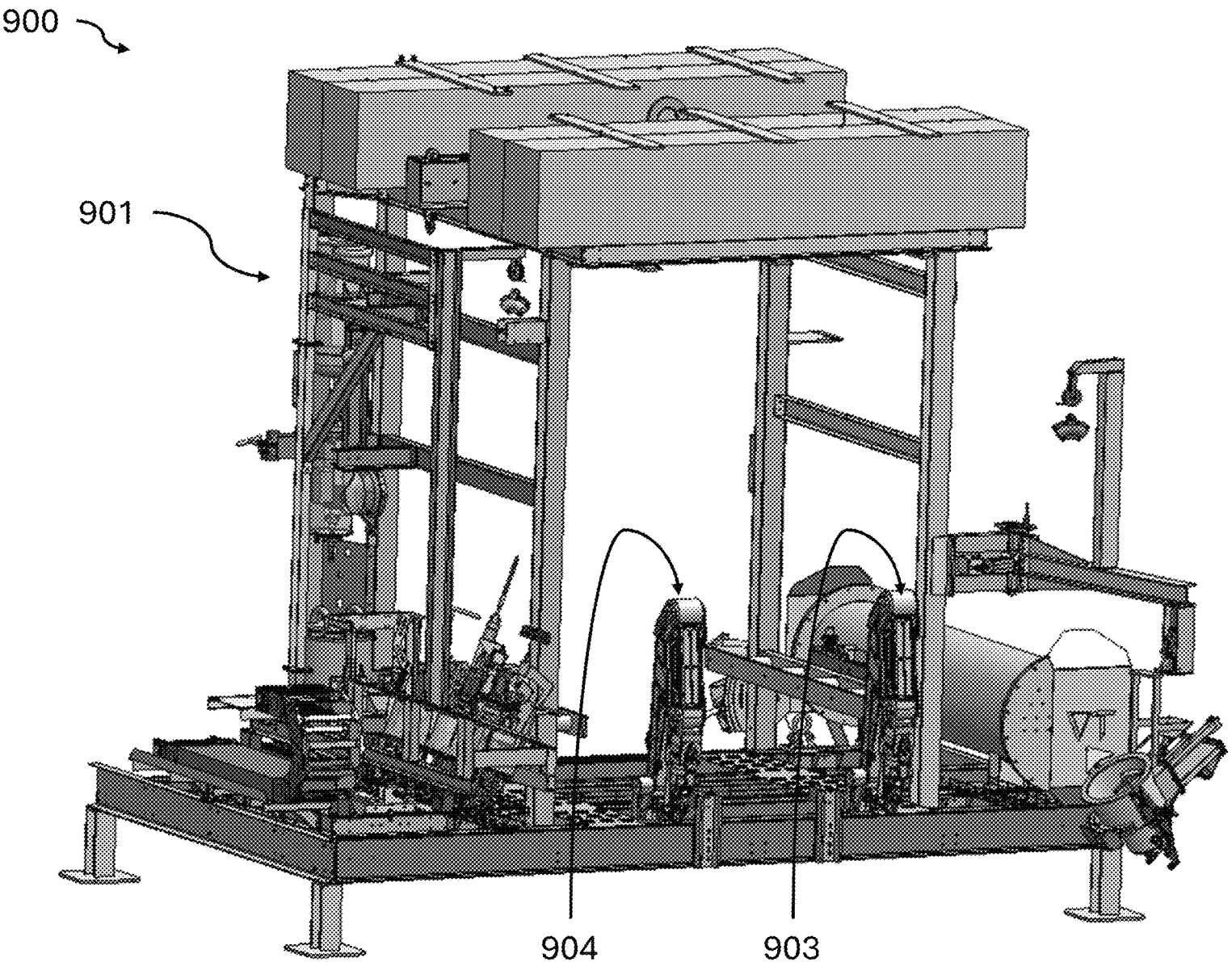
FIG. 9 is an illustration of an exemplary cut-and-capture system configured for demilitarization of an underwater munition, wherein the cut-and-capture system includes a demilitarization skid, a first manipulator arm, and a second manipulator arm, and wherein the cut-and-capture system does not include a ROV.

FIG. 9 is an illustration of an exemplary cut-and-capture system 900 configured for demilitarization of an underwater munition. The cut-and-capture system 900 includes a demilitarization skid 901, a first manipulator arm 903, and a second manipulator arm 904. The elements depicted in FIG. 1 are also included in FIG. 9, but the ROV of FIG. 2 is not intended to be included in the cut-and-capture system 900, even underwater. The reason that the ROV may be omitted from the cut-and-capture system 900 of FIG. 9 is because the first manipulator arm 903 as well as the second manipulator arm 904 are built directly into the cut-and-capture system 900. In embodiments utilizing an integrated tooling system, only one of the manipulator arms 903 or 904 is necessary. In some embodiments, dynamic positioning equipment such as thrusters, geopositioning systems, attitude sensors, and depth sensors may be integrated into the skid with or without a separate ROV to provide an independent dynamic positioning system that may or may not be used in conjunction with a crane, caterpillar track, and/or ROV thrusters to position and reposition the skid near or over a munition.

Figure 10:
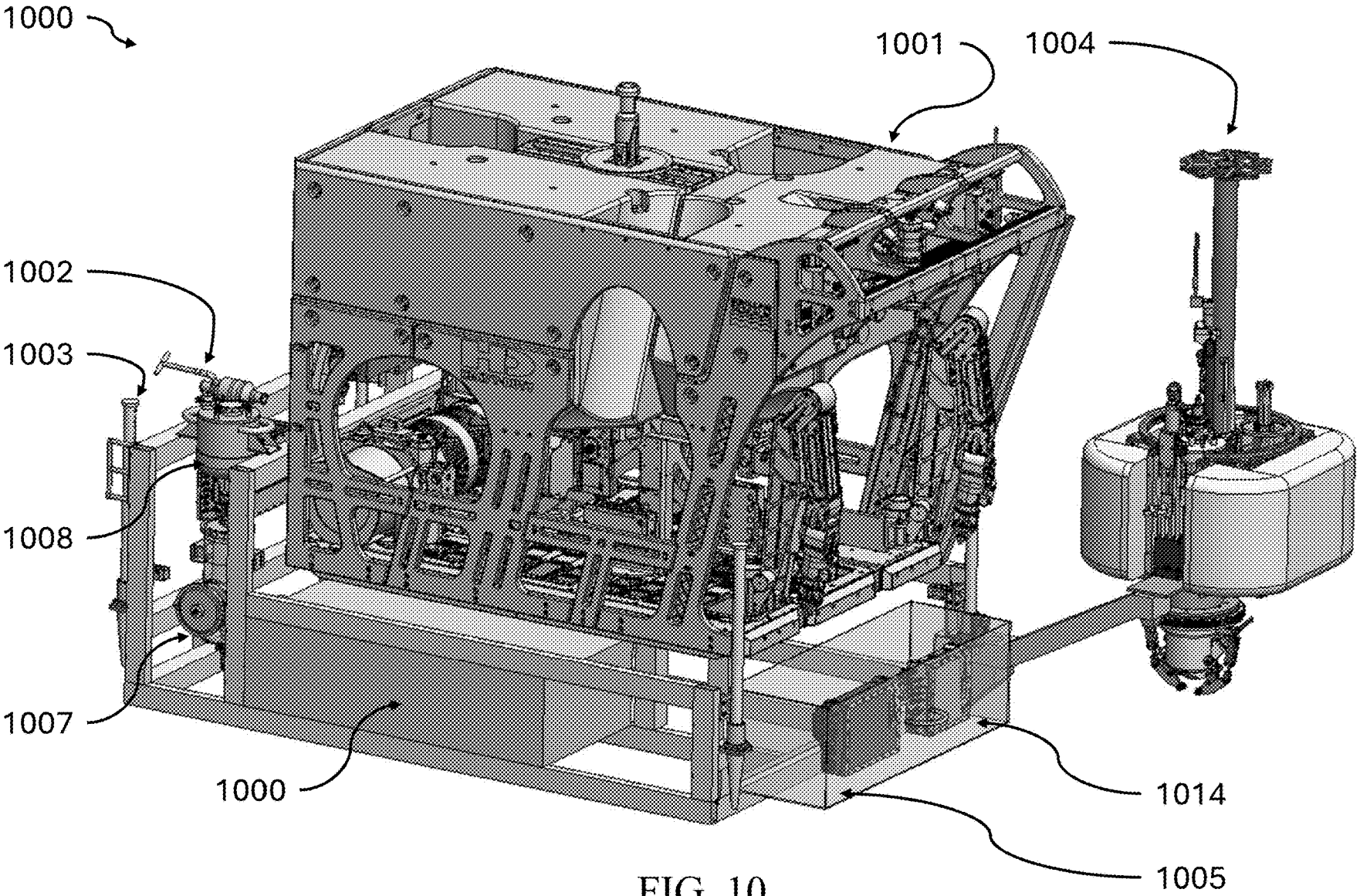
FIG. 10 is an illustration of an exemplary cut-and-capture system configured for demilitarization of an underwater munition, wherein the cut-and-capture system includes a remotely operated vehicle, a subsea hot-stab sub-system, retractable legs, a multifunctional device, a slide-out drawer, an abrasive feeder, an abrasive hopper, and a system control module (e.g., a SEHM).

FIG. 10 is an illustration of an exemplary cut-and-capture system 1000 configured for demilitarization of an underwater munition. The cut-and-capture system 1000 includes a remotely operated vehicle 1001, a subsea hot-stab sub-system 1002, retractable legs 1003, a multifunctional device 1004, a slide-out drawer 1005, an abrasive feeder 1007, an abrasive hopper 1008, and a system control module 1014 (e.g., a SEHM). The subsea hot-stab sub-system 1002 is configured for a process water connection, a capture hot-stab connection, and a waste hot-stab connection. The multifunctional device 1004 can be replaced with a docking platform and tool rack, or a docking platform and tool rack can be added to the system of FIG. 10, keeping the multifunctional device 1004.

As will be appreciated by a person skilled in the art, there are various alternatives that include more or fewer components in the cut-and-capture system. Some of these alternatives will now be described.

Some embodiments provide a cut-and-capture system configured for demilitarization of an underwater munition, wherein the cut-and-capture system comprises:

(a) a docking platform that is sealably positionable onto an underwater munition;

(b) a first manipulator arm configured to manipulate the docking platform onto the underwater munition;

(c) a high-pressure entrainment-style waterjet cutting tool configured to be reversibly sealably placed into the docking platform when the docking platform is sealably positioned onto the underwater munition, wherein the high-pressure entrainment-style waterjet cutting tool is configured to apply high-pressure water and an abrasive to the underwater munition, to create a munition coupon and to provide a munition access hole;

(d) a second manipulator arm configured to manipulate the high-pressure entrainment-style waterjet cutting tool into the docking platform;

(e) an abrasive feed subsystem configured to controllably deliver the abrasive to the high-pressure entrainment-style waterjet cutting tool;

(f) a washout tool configured to be reversibly sealably placed in the docking platform when the docking platform is sealably positioned onto the underwater munition, wherein the second manipulator arm, or a third manipulator arm, is configured to manipulate the washout tool into the docking platform, and wherein the washout tool is configured to generate munition waste derived from the underwater munition;

(g) a munition-waste bladder configured to receive and store the munition waste when in flow connection, via a sealed bladder line, with the docking platform;

(h) at least a first system control module configured with electrical control hardware and optionally with hydraulic control hardware, wherein the system control module is configured to control the docking platform, the high-pressure entrainment-style waterjet cutting tool, the abrasive feed subsystem, and the washout tool; and (i) a remotely operated vehicle disposed in electrical communication with the first system control module and/or with a second system control module.

Some embodiments utilizing a multifunctional device provide a cut-and-capture system configured for demilitarization of an underwater munition, the system comprising:

(a) a multifunctional device that is sealably positionable onto an underwater munition, wherein the multifunctional device is configured with (i) a high-pressure entrainment-style waterjet cutting tool, wherein the high-pressure entrainment-style waterjet cutting tool is configured to apply high-pressure water and an abrasive to the underwater munition, to create a munition coupon and to provide a munition access hole; (ii) a washout tool configured to generate munition waste derived from the underwater munition; and (iii) optionally, additional tools;

(b) a manipulator arm configured to manipulate the multifunctional device onto the underwater munition;

(c) an abrasive feed subsystem configured to controllably deliver the abrasive to the high-pressure entrainment-style waterjet cutting tool;

(d) a munition-waste bladder configured to receive and store the munition waste when in flow connection, via a sealed bladder line, with the multifunctional device;

(e) at least a first system control module configured with electrical control hardware and optionally with hydraulic control hardware, wherein the system control module is configured to control the multifunctional device and the abrasive feed subsystem; and (f) a remotely operated vehicle disposed in electrical communication with the first system control module and/or with a second system control module.

Some embodiments provide a system that does not (yet) contain any manipulator arms. The manipulator arms are provided at a later time by the ROV. For example, a skid may be fabricated in a shop without manipulator arms, and the tools are designed to be manipulated with one or more ROV manipulator arms.

Some embodiments provide a system comprising:

(a) a docking platform that is sealably positionable onto an underwater munition;

(b) a high-pressure entrainment-style waterjet cutting tool configured to be reversibly sealably placed into the docking platform when the docking platform is sealably positioned onto the underwater munition, wherein the high-pressure entrainment-style waterjet cutting tool is configured to apply high-pressure water and an abrasive to the underwater munition, to create a munition coupon and to provide a munition access hole;

(c) an abrasive feed subsystem configured to controllably deliver the abrasive to the high-pressure entrainment-style waterjet cutting tool;

(d) a washout tool configured to be reversibly sealably placed in the docking platform when the docking platform is sealably positioned onto the underwater munition, wherein the second manipulator arm, or a third manipulator arm, is configured to manipulate the washout tool into the docking platform, and wherein the washout tool is configured to generate munition waste derived from the underwater munition;

(e) a munition-waste bladder configured to receive and store the munition waste when in flow connection, via a sealed bladder line, with the docking platform;

(f) at least a first system control module configured with electrical control hardware and optionally with hydraulic control hardware, wherein the system control module is configured to control the docking platform, the high-pressure entrainment-style waterjet cutting tool, the abrasive feed subsystem, and the washout tool; and (g) optionally, a remotely operated vehicle disposed in electrical communication with the first system control module and/or with a second system control module.

Some embodiments utilizing a multifunctional device provide a system comprising:

(a) a multifunctional device that is sealably positionable onto an underwater munition, wherein the multifunctional device is configured with (i) a high-pressure entrainment-style waterjet cutting tool, wherein the high-pressure entrainment-style waterjet cutting tool is configured to apply high-pressure water and an abrasive to the underwater munition, to create a munition coupon and to provide a munition access hole; (ii) a washout tool configured to generate munition waste derived from the underwater munition; and (iii) optionally, additional tools;

(b) an abrasive feed subsystem configured to controllably deliver the abrasive to the high-pressure entrainment-style waterjet cutting tool;

(c) a munition-waste bladder configured to receive and store the munition waste when in flow connection, via a sealed bladder line, with the multifunctional device;

(d) at least a first system control module configured with electrical control hardware and optionally with hydraulic control hardware, wherein the system control module is configured to control the multifunctional device and the abrasive feed subsystem; and (e) optionally, a remotely operated vehicle disposed in electrical communication with the first system control module and/or with a second system control module.

Some embodiments provide a system that does not (yet) contain a munition-waste bladder. For example, a skid may be fabricated in a shop without a munition-waste bladder, and the skid is designed to be connected (such as via subsea hot stab) to the munition-waste bladder. Although not preferred, it is also possible for such a system (without a bladder) to be a cut system, rather than a cut-and-capture system.

Some embodiments provide a system comprising:

(a) a docking platform that is sealably positionable onto an underwater munition;

(b) optionally, a first manipulator arm configured to manipulate the docking platform onto the underwater munition;

(c) optionally, a second manipulator arm configured to manipulate the high-pressure entrainment-style waterjet cutting tool into the docking platform;

(d) a high-pressure entrainment-style waterjet cutting tool configured to be reversibly sealably placed into the docking platform when the docking platform is sealably positioned onto the underwater munition, wherein the high-pressure entrainment-style waterjet cutting tool is configured to apply high-pressure water and an abrasive to the underwater munition, to create a munition coupon and to provide a munition access hole;

(e) an abrasive feed subsystem configured to controllably deliver the abrasive to the high-pressure entrainment-style waterjet cutting tool;

(f) a washout tool configured to be reversibly sealably placed in the docking platform when the docking platform is sealably positioned onto the underwater munition, wherein the second manipulator arm, or a third manipulator arm, is configured to manipulate the washout tool into the docking platform, and wherein the washout tool is configured to generate munition waste derived from the underwater munition;

(g) at least a first system control module configured with electrical control hardware and optionally with hydraulic control hardware, wherein the system control module is configured to control the docking platform, the high-pressure entrainment-style waterjet cutting tool, the abrasive feed subsystem, and the washout tool; and (h) optionally, a remotely operated vehicle disposed in electrical communication with the first system control module and/or with a second system control module.

Some embodiments utilizing a multifunctional device provide a system comprising:

(a) a multifunctional device that is sealably positionable onto an underwater munition, wherein the multifunctional device is configured with (i) a high-pressure entrainment-style waterjet cutting tool, wherein the high-pressure entrainment-style waterjet cutting tool is configured to apply high-pressure water and an abrasive to the underwater munition, to create a munition coupon and to provide a munition access hole; (ii) a washout tool configured to generate munition waste derived from the underwater munition; and (iii) optionally, additional tools;

(b) optionally, a manipulator arm configured to manipulate the multifunctional device onto the underwater munition;

(c) an abrasive feed subsystem configured to controllably deliver the abrasive to the high-pressure entrainment-style waterjet cutting tool;

(d) at least a first system control module configured with electrical control hardware and optionally with hydraulic control hardware, wherein the system control module is configured to control the multifunctional device and the abrasive feed subsystem; and (e) optionally, a remotely operated vehicle disposed in electrical communication with the first system control module and/or with a second system control module.

Other embodiments are premised on the fact that the disclosed cut-and-capture system is capable of cutting or otherwise processing items other than munitions. As one example, sometimes munitions are heavily encrusted with coral and not readily removable from the seafloor, which may be why they remain in place. The cut-and-capture system may be used to waterjet-cut coral in order to gain better access to the munition.

Still other embodiments are premised on the recognition that the disclosed cut-and-capture system is capable of cutting or otherwise processing items that have nothing to do with munitions. For example, the cut-and-capture system may be used to cut a pipeline such as for repair, where the capture principles are applied to capture crude oil to avoid subsea leakage. The cut-and-capture system may be used to cut electrical or telecommunications cables, where the capture principles are applied to capture conductor, capacitor, or insulator materials, or anti-corrosion coating chemicals, for example.

EXAMPLES

Exemplary equipment that may be present in the cut-and-capture system, and methods of use, will now be further described. Some examples will utilize less than all of the described equipment, or more than the described equipment. In these examples, "subsea" refers to submersion in a body of water, typically but not necessarily a sea.

A demil skid is a sophisticated package of equipment integrated into a main frame that holds all the equipment. The demil skid is lowered to the sea floor in the vicinity of an identified munition. The demil skid contains buoyancy so that it can be relocated subsea via a ROV's thrusters and dynamic positioning system. The demil skid contains an area where the ROV can dock so the manipulator arms of the ROV can be used to conduct neutralization/demilitarization operations.

A subsea electronic and hydraulic module (SEHM) is a "dry box" maintained at 1 atm absolute pressure. The SEHM contains all the electrical and control hardware as well as a hydraulic manifold and directional/proportional hydraulic control valves. The power line and fiber optic cable from the umbilical plug into the control end of the SEHM. The control end also has numerous electrical connections that are routed to all electronically powered equipment on the demil skid such as proximity sensors, cameras, lights, servo motors, rotary encoders, pressure transducers, etc. The hydraulic end of the SEHM receives the two hydraulic lines from the umbilical. This end also contains numerous hydraulic lines that are routed to the hydraulic equipment on the demil skid; the internal hydraulic manifold is plumbed inside the SEHM to the connections on the hydraulic end of the SEHM. The SEHM may be a single physical module, or a plurality of physical sub-modules, such as a first sub-module containing electrical and control hardware, and a second sub-module containing hydraulic control valves.

A hydraulically driven dual diaphragm pump has suction connected to the demil skid and discharge connected to the subsea bladder. This pump draws surrounding water through the docking platform, through the capture pump, and into the subsea bladder during cutting, washout, and tool-change operations.

A docking platform is positioned onto the munition item via the first manipulator arm. The dock contains cameras for viewing inside the sealed chamber as well as a hydraulically driven valve to seal off the munition from surrounding water during tool changes. Hydraulically powered clamps (munition clamps) are used to draw the munition into a highly compressible seal (munition seal) on the dock. Another set of hydraulically powered clamps (tooling clamps) are then used to clamp the desired tool to the dock.

A cutting tool mates to the dock and allows for high-pressure waterjet cutting to occur. A servo motor is used to rotate the cutting head in a circle so that a plug (coupon) is cut into the side of the munition. The cutting tool also contains a camera for viewing. An actuated, protected ferrous magnet assembly is embedded into this tool to remove the coupon after cutting, wherein a shroud protects the ferrous magnet from buildup of metal particles. A hydraulic cylinder is used to extend and retract the magnet.

An abrasive hopper and abrasive feeder deliver abrasive material to the high-pressure entrainment-style abrasive cutting head. Pressurized air tanks supply air to the abrasive feed system. These tanks are replaceable subsea with a hot-stab connection that can be accomplished with the ROV.

After cutting, the cutting tool is removed, the washout tool is placed in the dock, and the dock's tooling clamps apply pressure to a flange on the washout tool, sealing it onto the dock. A rotary servo motor allows a washout nozzle to be rotated while inserted through the hole cut into the item. A linear servo motor is used to insert/retract the washout nozzle. The washout nozzle may be insertable into the munition access hole, or just positioned in close proximity to, and sealed with, the munition access hole.

A cleaning tool is manipulated by the ROV's arm and is used prior to attaching the dock to the munition. The cleaning contains a multi-orifice cleaning head that rotates at 50 RPM or more, with a hydraulic motor. The cleaning tool is used to clean the surface of the item prior to attaching the dock so that a tight seal can be made between the munition and the dock.

After the ROV docks itself inside the demil skid via front pins and rear tail latch, the process of demilitarizing the ordnance item is as follows, in these examples.

The second manipulator arm (e.g., a Titan T-4 arm) retrieves the cleaning tool from the tool rack and positions it over the area to be cleaned. The control system is used to turn on high-pressure water to the cleaning tool and to cause the hydraulic motor to spin when it is turned on. The second manipulator arm moves the cleaning tool over the area to be cleaned. Once the area has been cleaned, the hydraulic motor and high-pressure water are turned off and the second manipulator arm puts the cleaning tool back in the tool rack.

The first manipulator arm (e.g., an Atlas arm) grabs the dock and places it on the cleaned munition. The SEHM is used to drive the hydraulically powered munition clamps to draw the dock's munition seal to the munition. The first manipulator arm continues to hold the dock in place.

The second manipulator arm grabs the cutting tool from the tool rack and places it on the dock. The control system is used to clamp the dock to the cutting tool via hydraulic tooling clamps. The second manipulator arm may continue holding the cutting tool during the cutting and plug removal operation, or the second manipulator arm can release its hold on the cutting tool to maintenance other parts of the system during the cut and plug removal operation. During cutting, the capture pump (dual diaphragm pump) is operated to pull local water through the dock and into the bladder, in order to capture all effluent. The pump can be stopped after cutting and plug removal, but it may also continue its operation during tool changes to reduce risk of munition fill contaminating the environment.

The cutting tool is unclamped from the dock and removed. The SEHM is used to close a hydraulically actuated isolation valve on the dock while the tool change is occurring. The second manipulator arm places the cutting tool back in the tool rack.

The second manipulator arm grabs the washout tool and places it in the dock after the isolation valve is opened. Tooling clamps on the dock are actuated to seal the washout tool to the dock.

Controlled washout of the munition via high-pressure water blasting proceeds. The dual diaphragm pump is used to carry all washed-out energetic munition waste to the bladder. After washout, the pump is stopped. The washout tool is unclamped from the dock and removed with the second manipulator arm.

An inspection of the munition can be completed via a camera which can be manipulated via the second manipulator arm. The camera is housed inside an inspection tool that can seat itself into the dock. After the inspection tool is inserted into the dock, the dock's tooling clamps are used to seal the inspection tool to the dock. The second manipulator arm is able to rotate the camera inside the item manually to observe the cleanliness the item.

The first manipulator arm holding the dock is used to place the dock back into the dock rack holder after the hydraulic tooling clamps release the dock from the processed munition.

The umbilical from the surface is attached to the demil skid and contains the following lines:

(i) a pair of hydraulic lines that deliver and return hydraulic fluid from the surface hydraulic power unit (HPU) to the subsea electronic and hydraulic module (SEHM);

(ii) a multi-fiber fiber optic cable that allows for control communication from the surface to the subsea electronics and hydraulic manifold (SEHM), and transmits video to the surface from subsea cameras;

(iii) a 480 VAC 3-phase power cable that delivers power from the generator to the SEHM; and (iv) a high-pressure water line that delivers high-pressure (e.g., at least 40,000 psig) water from the high-pressure pump or intensifier to the demil skid.

A subsea bladder is contained in a bladder structure and is lowered to the seafloor with the crane. The bladder is used to collect the cutting and washout effluent during those operations of the neutralization/demilitarization process. The bladder is permanently connected to a hose, where the other end of the hose is connected to the demil skid via an ROV actuated hot-stab connection.

A remotely operated vehicle (ROV) is initially located on the deck of a ship, barge, or pier. The ROV has two manipulator arms. The ROV may use a non-standard tail latch and front female pins to be able to dock to the demilitarization equipment. As an example, the ROV may be a Schilling Robotics Heavy Duty (HD) 150 HP ROV that contains one Titan T-4 arm and one Atlas arm. The ROV has its own support equipment such as control van, operators, utilities, tether, tether management system (TMS), and launch and recovery system (LARS).

Utilities are located on the deck of a ship, barge, pier, or shore. Utilizes include a hydraulic power unit (HPU), an air compressor, an electric power generator, a high-pressure pump or intensifier, a filtered freshwater supply, a refrigeration unit, and electrical control panel(s).

A control system and human-machine interface (HMI) are located on the deck of a ship, barge, pier, or shore. A programmable logic controller (PLC) system with distributed I/O is used to communicate and control all equipment above and below water. A HMI such as a touch panel or computer is used to interact with the control system.

A video system enables subsea cameras to transmit video (or photographs) back to the surface via fiber optics where monitors and a digital video recorder are used to capture and display real-time video.

An umbilical is used with an umbilical reel located on the deck of a ship, barge, pier, or shore. A hydraulically controlled reel containing a 600-foot (or other effective length) umbilical is located above water and is attached to corresponding equipment above water. The other end of the umbilical is attached to the subsea demilitarization skid. Hydraulic control is used to reel out or reel in the umbilical as the demil skid is lowered into the water or retrieved from the water.

A crane hoist is located on the deck of a ship, barge, or pier. The crane is used to raise or lower the demil skid and the subsea bladder to the seafloor as needed for demilitarization operations.

An exemplary deployment of the cut-and-capture system from a ship will now be described.

A ship containing a ROV and crane is loaded with all support equipment, the demil skid, and the subsea bladder. Multiple 20-foot containers house supporting equipment. One container houses the high-pressure pump and refrigeration unit that cools the high-pressure pump. An intensifier-style high-pressure pump (100 hp) delivers 2 gpm of water at 60,000 psig. Power is connected to this container from the generator. Fresh water available on the ship is connected to the container and provides feed water to the high-pressure pump. A second container houses utilities such as an air compressor, hydraulic power unit, and electrical/control panels. Power is connected to this container from the generator. A third container is divided into two sections. One section is a maintenance shop containing tools and spare parts. The other section is a control room containing computers, monitors, video monitors, and a DVR.

The umbilical reel is placed on the deck such that it can be connected to electrical power, hydraulic power, control/video communications, the high-pressure pump, and the demil skid. The demil skid is placed on the deck such that it can be deployed using the crane over the side of the ship. The bladder is also placed on the deck where it can be deployed using the crane.

Once the ship is at the desired location where munitions have been identified, the ship is dynamically positioned such that it remains stationary. Next, the launch and recovery system places the ROV in the water. The crane is then used to lower the demil skid into the water and place the skid on the seafloor. The ROV is used to disconnect the rigging from the demil skid. The crane is used to place the subsea bladder on the sea floor in the vicinity of the demil skid. Finally, the ROV is used to disconnect the rigging from the bladder.

Once all equipment is on the sea floor, the ROV plugs the hot stab of the hose from the bladder into the receptacle on the demil skid. The ROV then docks into the demil skid for operations.

Buoyancy blocks are used on the demil skid to reduce its weight in water so the ROV can move it subsea to another location.

After subsea work is complete, the ROV departs its position in the demil skid and transports around to remove the bladder hose hot stab. The bladder can now be hoisted to the deck of the ship when needed. Subsequently, the demil skid can also be hoisted to the deck of the ship when needed. Rigging attachments from the crane to the demil skid may be made by the ROV.

The shell of the cleaned munition can be removed or left on the seafloor. If other munitions remain within reach of the manipulator arms, the other munitions can now be processed. If other munition items remain near the demil skid but not within reach of the manipulator arms, the ROV may lift and relocate the skid using the ROV thrusters.

In this detailed description, reference has been made to multiple embodiments and to the accompanying drawings in which are shown by way of illustration specific exemplary embodiments of the invention. These embodiments are described in sufficient detail to enable those skilled in the art to practice the invention, and it is to be understood that modifications to the various disclosed embodiments may be made by a skilled artisan.

Where methods and steps described above indicate certain events occurring in certain order, those of ordinary skill in the art will recognize that the ordering of certain steps may be modified and that such modifications are in accordance with the variations of the invention. Additionally, certain steps may be performed concurrently in a parallel process when possible, as well as performed sequentially.

All publications, patents, and patent applications cited in this specification are herein incorporated by reference in their entirety as if each publication, patent, or patent application were specifically and individually put forth herein.

The embodiments, variations, and figures described above should provide an indication of the utility and versatility of the present invention. Other embodiments that do not provide all of the features and advantages set forth herein may also be utilized, without departing from the spirit and scope of the present invention. Such modifications and variations are considered to be within the scope of the invention defined by the claims.

What is claimed is:

1. A cut-and-capture system configured for demilitarization of an underwater munition, wherein said cut-and-capture system comprises:

(a) a docking platform that is sealably positionable onto an underwater munition;

(b) a first manipulator arm configured to manipulate said docking platform onto said underwater munition;

(c) a high-pressure entrainment-style waterjet cutting tool configured to be reversibly sealably placed into said docking platform when said docking platform is sealably positioned onto said underwater munition, wherein said high-pressure entrainment-style waterjet cutting tool is configured to apply high-pressure water and an abrasive to said underwater munition, to create a munition coupon and to provide a munition access hole;

(d) a second manipulator arm configured to manipulate said high-pressure entrainment-style waterjet cutting tool into said docking platform;

(e) an abrasive feed subsystem configured to controllably deliver said abrasive to said high-pressure entrainment-style waterjet cutting tool;

(f) a washout tool configured to be reversibly sealably placed in said docking platform when said docking platform is sealably positioned onto said underwater munition, wherein said second manipulator arm, or a third manipulator arm, is configured to manipulate said washout tool into said docking platform, and wherein said washout tool is configured to generate munition waste derived from said underwater munition;

(g) a munition-waste bladder configured to receive and store said munition waste when in flow connection, via a sealed bladder line, with said docking platform; and (h) at least a first system control module configured with electrical control hardware, wherein said system control module is configured to control said docking platform, said high-pressure entrainment-style waterjet cutting tool, said abrasive feed subsystem, and said washout tool.

2. The cut-and-capture system of claim 1, wherein said docking platform is capable of being sealably positioned onto said underwater munition using munition clamps, magnets, electromagnets, suction, or a combination thereof.

3. The cut-and-capture system of claim 1, wherein said high-pressure entrainment-style waterjet cutting tool is rotatable and/or translatable to create a circular or slotted form of said munition coupon from said underwater munition.

4. The cut-and-capture system of claim 1, wherein said cut-and-capture system further comprises a coupon-removal tool configured to remove said munition coupon from said munition access hole.

5. The cut-and-capture system of claim 1, wherein said cut-and-capture system contains a pump configured to convey surrounding water through said docking platform and into said munition-waste bladder during cutting, washout, inspection, plugging, or tool changes.

6. The cut-and-capture system of claim 5, wherein said munition-waste bladder is configured with two hoses to enable flow of said surrounding water through said munition-waste bladder and back to said docking platform.

7. The cut-and-capture system of claim 1, wherein said washout tool contains a washout nozzle, and wherein said washout nozzle is configured to wash out said underwater munition via said munition access hole with said high-pressure water and/or with a water source different than said high-pressure water.

8. The cut-and-capture system of claim 1, wherein said cut-and-capture system further comprises a cleaning tool configured to be mobilized by said second manipulator arm or a third manipulator arm, and wherein said cleaning tool is configured with a cleaning nozzle to clean a surface of said underwater munition using said high-pressure water and/or a water source different than said high-pressure water.

9. The cut-and-capture system of claim 1, wherein said cut-and-capture system further comprises a defusing tool configured to disarm a fuse within said underwater munition.

10. The cut-and-capture system of claim 1, wherein said cut-and-capture system further comprises an inspection tool configured to be reversibly and sealably placed into said docking platform when said docking platform is sealably positioned onto said underwater munition.

11. The cut-and-capture system of claim 10, wherein a visible-light camera, an infrared camera, or a sonar detector is installed within said inspection tool to view or analyze an inside region of said underwater munition.

12. The cut-and-capture system of claim 1, wherein said cut-and-capture system further comprises a plugging tool configured to seal said munition access hole.

13. The cut-and-capture system of claim 1, wherein said cut-and-capture system contains a tool rack configured to hold a plurality of tools, and wherein said tool rack is adapted with tool retractors to enable use of a selected tool.

14. The cut-and-capture system of claim 1, wherein said cut-and-capture system further comprises one or more pressurized air tanks configured to supply air to said abrasive feed subsystem.

15. The cut-and-capture system of claim 14, wherein said one or more pressurized air tanks are replaceable underwater via a hot-stab connection performed by said second manipulator arm or another manipulator arm.

16. The cut-and-capture system of claim 1, wherein said first system control module is configured to also control said first manipulator arm and said second manipulator arm.

17. The cut-and-capture system of claim 1, wherein said cut-and-capture system further comprises a second system control module, and wherein said second system control module is configured to control said first manipulator arm and said second manipulator arm.

18. The cut-and-capture system of claim 1, wherein said first system control module is powered and communicated via an umbilical that connects to power and communications equipment above water.

19. The cut-and-capture system of claim 1, wherein said first system control module is powered via an underwater utility module.

20. The cut-and-capture system of claim 1, wherein said cut-and-capture system further comprises a remotely operated vehicle, and wherein said remotely operated vehicle is disposed in electrical communication with said first system control module and/or with a second system control module contained on said remotely operated vehicle.

21. The cut-and-capture system of claim 20, wherein said remotely operated vehicle is configured to operate said first manipulator arm and said second manipulator arm.

22. The cut-and-capture system of claim 21, wherein said first manipulator arm and said second manipulator arm are operated by said second system control module, and wherein said docking platform, said high-pressure entrainment-style waterjet cutting tool, said abrasive feed subsystem, and said washout tool are operated by said first system control module.

23. The cut-and-capture system of claim 1, wherein said cut-and-capture system is disposed on a skid.

24. The cut-and-capture system of claim 23, wherein said cut-and-capture system is configured with one or more buoyancy devices attached to said skid.

25. The cut-and-capture system of claim 1, wherein said cut-and-capture system is submerged in a body of water.

26. A cut-and-capture system configured for demilitarization of an underwater munition, wherein said cut-and-capture system comprises:

(a) a multifunctional device that is positionable onto an underwater munition, wherein said multifunctional device is configured with (i) a high-pressure entrainment-style waterjet cutting tool, wherein said high-pressure entrainment-style waterjet cutting tool is configured to apply high-pressure water and an abrasive to said underwater munition, to create a munition coupon and to provide a munition access hole; (ii) a washout tool configured to generate munition waste derived from said underwater munition; and (iii) optionally, additional tools;

(b) a manipulator arm configured to manipulate said multifunctional device onto said underwater munition;

(c) an abrasive feed subsystem configured to controllably deliver said abrasive to said high-pressure entrainment-style waterjet cutting tool;

(d) a munition-waste bladder configured to receive and store said munition waste when in flow connection, via a sealed bladder line, with said multifunctional device; and (e) at least a first system control module configured with electrical control hardware, wherein said system control module is configured to control said multifunctional device and said abrasive feed subsystem.

27. The cut-and-capture system of claim 26, wherein said multifunctional device is capable of being sealably positioned onto said underwater munition using munition clamps, magnets, electromagnets, suction, or a combination thereof.

28. The cut-and-capture system of claim 26, wherein said high-pressure entrainment-style waterjet cutting tool is rotatable and/or translatable to create a circular or slotted form of said munition coupon from said underwater munition.

29. The cut-and-capture system of claim 26, wherein said multifunctional device further comprises a coupon-removal tool configured to remove said munition coupon from said munition access hole.

30. The cut-and-capture system of claim 26, wherein said cut-and-capture system contains a pump configured to convey surrounding water through said multifunctional device and into said munition-waste bladder during cutting, washout, inspection, plugging, or tool changes.

31. The cut-and-capture system of claim 30, wherein said munition-waste bladder is configured with two hoses to enable flow of said surrounding water through said munition-waste bladder.

32. The cut-and-capture system of claim 26, wherein said washout tool contains a washout nozzle, and wherein said washout nozzle is configured to wash out said underwater munition via said munition access hole with said high-pressure water and/or with a water source different than said high-pressure water.

33. The cut-and-capture system of claim 26, wherein said multifunctional device further comprises a defusing tool configured to disarm a fuse within said underwater munition.

34. The cut-and-capture system of claim 26, wherein said multifunctional device further comprises an inspection tool.

35. The cut-and-capture system of claim 34, wherein a visible-light camera, an infrared camera, or a sonar detector is installed within said inspection tool to view or analyze an inside region of said underwater munition.

36. The cut-and-capture system of claim 26, wherein said multifunctional device further comprises a cleaning tool configured with a cleaning nozzle to clean a surface of said underwater munition using said high-pressure water and/or a water source different than said high-pressure water.

37. The cut-and-capture system of claim 26, wherein said multifunctional device further comprises a plugging tool configured to seal said munition access hole.

38. The cut-and-capture system of claim 26, wherein said cut-and-capture system further comprises one or more pressurized air tanks configured to supply air to said abrasive feed subsystem.

39. The cut-and-capture system of claim 38, wherein said one or more pressurized air tanks are replaceable underwater via a hot-stab connection performed by said manipulator arm or another manipulator arm.

40. The cut-and-capture system of claim 26, wherein said first system control module is configured to also control said manipulator arm.

41. The cut-and-capture system of claim 26, wherein said cut-and-capture system further comprises a second system control module, and wherein said second system control module is configured to control said manipulator arm.

42. The cut-and-capture system of claim 26, wherein said first system control module is powered and communicated via an umbilical that connects to power and communications equipment above water.

43. The cut-and-capture system of claim 26, wherein said first system control module is powered via an underwater utility module.

44. The cut-and-capture system of claim 26, wherein said cut-and-capture system further comprises a remotely operated vehicle, and wherein said remotely operated vehicle is disposed in electrical communication with said first system control module and/or with a second system control module contained on said remotely operated vehicle.

45. The cut-and-capture system of claim 44, wherein said remotely operated vehicle is configured to operate said first arm.

46. The cut-and-capture system of claim 45, wherein said manipulator arm is operated by said second system control module, and wherein said multifunctional device is operated by said first system control module.

47. The cut-and-capture system of claim 26, wherein said cut-and-capture system is disposed on a skid.

48. The cut-and-capture system of claim 47, wherein said cut-and-capture system is configured with one or more buoyancy devices attached to said skid.

49. The cut-and-capture system of claim 26, wherein said cut-and-capture system is submerged in a body of water.

* * * * *